US011872613B2

(12) United States Patent
Ishii et al.

(10) Patent No.: US 11,872,613 B2
(45) Date of Patent: Jan. 16, 2024

(54) ROLLING MILL, AND METHOD FOR SETTING ROLLING MILL

(71) Applicant: NIPPON STEEL CORPORATION, Tokyo (JP)

(72) Inventors: Atsushi Ishii, Tokyo (JP); Kazuma Yamaguchi, Tokyo (JP); Daisuke Nikkuni, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 142 days.

(21) Appl. No.: 17/055,656

(22) PCT Filed: May 29, 2019

(86) PCT No.: PCT/JP2019/021425

§ 371 (c)(1),
(2) Date: Nov. 16, 2020

(87) PCT Pub. No.: WO2019/230850

PCT Pub. Date: Dec. 5, 2019

(65) Prior Publication Data

US 2021/0229148 A1 Jul. 29, 2021

(30) Foreign Application Priority Data

May 29, 2018 (JP) ..... 2018-102656

(51) Int. Cl.
*B21B 29/00* (2006.01)
*B21B 31/02* (2006.01)
(Continued)

(52) U.S. Cl.
CPC ..... *B21B 29/00* (2013.01); *B21B 31/02* (2013.01); *B21B 31/18* (2013.01); *B21B 38/00* (2013.01);
(Continued)

(58) Field of Classification Search
CPC ..... B21B 29/00; B21B 31/02; B21B 31/16; B21B 31/18; B21B 31/20; B21B 31/32;
(Continued)

(56) References Cited

U.S. PATENT DOCUMENTS 3,877,270 A * 4/1975 Marten ..... B21B 37/38 72/245
3,938,360 A * 2/1976 Shida ..... B21B 37/38 72/10.7
(Continued)

FOREIGN PATENT DOCUMENTS

CN 1636644 A 7/2005
CN 102548678 A 7/2012
(Continued)

OTHER PUBLICATIONS

KR 20130022865A, Shin et al. Mar. 2013.*
JP 10-263656A, Ogawa et al. Oct. 1998.*

*Primary Examiner* — Edward T Tolan
(74) *Attorney, Agent, or Firm* — Birch, Stewart, Kolasch & Birch, LLP

(57) ABSTRACT

A rolling mill of four-high or more is provided that includes: measurement apparatuses that adopt any one roll as a reference roll, and measure at least rolling direction forces acting on roll chocks on a work side and roll chocks on a drive side of each roll other than a backup roll; pressing apparatuses that press the roll chocks in the rolling direction; driving apparatuses that move the roll chocks in the rolling direction; and a position control unit that fixes a rolling direction position of the roll chocks of the reference roll as a reference position, and drives the driving apparatuses to control the positions in the rolling direction of the roll chocks based on a rolling direction force difference so that the rolling direction force difference of each roll is a value within an allowable range.

13 Claims, 17 Drawing Sheets

(51) Int. Cl.
*B21B 31/18* (2006.01)
*B21B 38/00* (2006.01)
*B21B 13/02* (2006.01)

(52) U.S. Cl.
CPC ... *B21B 2013/025* (2013.01); *B21B 2013/028* (2013.01); *B21B 2269/04* (2013.01)

(58) Field of Classification Search
CPC ... B21B 38/00; B21B 38/08; B21B 2013/025; B21B 2013/028; B21B 2269/04; B21B 2269/08; B21B 37/62; B21B 37/58; B21B 2271/02; B21B 31/185; B21B 37/68; B21B 2273/04
USPC ..... 72/241.8
See application file for complete search history.

(56) References Cited

U.S. PATENT DOCUMENTS

| | | | | |
|---|---|---|---|---|
| 7,310,982 | B2 * | 12/2007 | Ogawa | B21B 37/28 72/10.4 |
| 9,770,747 | B2 * | 9/2017 | Ishii | B21B 38/06 |
| 11,247,253 | B2 * | 2/2022 | Sako | B21B 37/18 |
| 2013/0000371 | A1 | 1/2013 | Kasai et al. | |
| 2017/0008055 | A1 * | 1/2017 | Norikura | B21B 13/14 |

FOREIGN PATENT DOCUMENTS

| | | | |
|---|---|---|---|
| JP | 8-294713 | A | 11/1996 |
| JP | 3499107 | B2 | 2/2004 |
| JP | 2006-110627 | A | 4/2006 |
| JP | 2009-178754 | A | 8/2009 |
| JP | 2014-4599 | A | 1/2014 |

* cited by examiner (b. ROLLING MILL EXIT SIDE)

(a. ROLLING MILL ENTRANCE SIDE)

ROLLING MILL, AND METHOD FOR SETTING ROLLING MILL

TECHNICAL FIELD

The present invention relates to a rolling mill that rolls a workpiece, and a method for setting the rolling mill.

BACKGROUND ART

In a hot rolling process, for example, zigzagging of a steel plate occurs as a phenomenon that is the cause of rolling trouble. A thrust force that is generated at a minute cross (also referred to as "roll skew") between rolls of a rolling apparatus is one cause of zigzagging of a steel plate, and it is difficult to directly measure such a thrust force. Therefore, in the past it has been proposed to measure a thrust counterforce that is detected as a counterforce that is the total value of thrust forces generated between rolls or a roll skew angle, and identify the thrust force generated between rolls based on the thrust counterforce or the roll skew angle and perform zigzagging control of the steel plate.

For example, Patent Document 1 discloses a plate rolling method which measures a thrust counterforce in the axial direction of a roll and a load in a vertical direction, determines either one of, or both of, a reduction position zero point and deformation properties of the rolling mill, and sets the reduction position at the time of rolling execution and controls rolling. Further, Patent Document 2 discloses a zigzagging control method that calculates a thrust force generated at a roll based on an inter-roll minute cross angle (skew angle) that is measured using a distance sensor provided inside a rolling mill and, based on the thrust force, calculates a differential load component that is a cause of zigzagging based on a load measurement value in the vertical direction and performs reduction leveling control. In addition, Patent Document 3 discloses a cross-point correcting device which corrects a deviation in a point (cross point) at which the central axes of upper and lower rolls cross in the horizontal direction in a pair cross rolling mill. The apparatus includes an actuator that absorbs play that arises between a crosshead and roll chocks, and a detector that detects roll chock positions, and corrects a deviation in the cross point based on the roll chock positions.

LIST OF PRIOR ART DOCUMENTS

Patent Document

Patent Document 1: JP3499107B
Patent Document 2: JP2014-4599A
Patent Document 3: JP8-294713A

SUMMARY OF INVENTION

Technical Problem

However, according to the technique disclosed in Patent Document 1, although it is necessary to perform measurement of the thrust counterforce of rolls other than a backup roll at a time of reduction position zero point adjustment and during rolling, in the case of measuring thrust counterforces during rolling, in some cases characteristics such as the working point of the thrust counterforce change depending on changes in the rolling conditions such as the rolling load, and asymmetric deformation that accompanies the thrust force cannot be correctly identified. Therefore, there is the possibility that reduction leveling control cannot be accurately performed.

Further, according to the technique disclosed in Patent Document 2, a roll skew angle is determined based on a distance in the horizontal direction of a roll that is measured by a distance sensor such as a vortex sensor. However, because a roll vibrates in the horizontal direction depending on the degree of machining precision such as the eccentricity or cylindricity of a roll body length portion, and chock positions in the horizontal direction fluctuate due to impact at the time of biting at the start of rolling and the like, it is difficult to accurately measure the horizontal displacement of a roll which is a factor that causes the generation of a thrust force. Furthermore, the coefficient of friction of a roll is constantly changing because the degree of roughness of a roll changes with time as the number of rolled workpieces increases. Therefore, calculation of a thrust force without identification of the coefficient of friction cannot be performed accurately based on only a roll skew angle measurement.

In addition, according to the technique disclosed in Patent Document 3, an inter-roll cross angle arises due to relative crossing of rolls, and since there is also looseness in roll bearings and the like, even if position control of each roll chock position is individually performed in the rolling direction, deviations in the relative positional relation between the rolls themselves are not eliminated. Consequently, thrust forces that are generated due to inter-roll cross angles cannot be eliminated.

Further, as normal preparation operations before rolling, after replacing work rolls, the zero point of the reduction position in a kiss roll state is adjusted by an operator based on the values of vertical roll loads on the work side and the drive side. At such time, if an inter-roll thrust force is generated due to an inter-roll minute cross, in some cases a difference arises between the vertical roll load on the work side and the vertical roll load on the drive side, and the reduction position zero point adjustment cannot be correctly performed. However, it is not possible to reduce an inter-roll thrust force prior to reduction position zero point adjustment by employing a technique disclosed in any of the patent documents described above.

The present invention has been made in view of the problems described above, and an objective of the present invention is to provide a novel and improved method for setting a rolling mill, and a rolling mill, before zero point of reduction position adjustment or before starting rolling, by reducing thrust forces generated between rolls and suppressing the occurrence of zigzagging and camber of a workpiece.

Solution to Problem

To solve the problems described above, according to one aspect of the present invention there is provided a rolling mill of four-high or more that includes a plurality of rolls including at least a pair of work rolls and a pair of backup rolls supporting the work rolls, wherein any one roll among respective rolls arranged in a vertical direction is adopted as a reference roll, the rolling mill including: a measurement apparatus which measures at least rolling direction forces in a rolling direction which act on roll chocks on a work side and roll chocks on a drive side of each of the rolls other than the backup rolls; a pressing apparatus which, with respect to at least roll chocks of the rolls other than the reference roll, is provided on either one of an entrance side and an exit side in the rolling direction, the pressing apparatus pressing a workpiece in the rolling direction; a driving apparatus which, with respect to at least roll chocks of the rolls other than the reference roll, is provided so as to face the pressing apparatus in the rolling direction, the driving apparatus moving a workpiece in the rolling direction; and a position control unit that fixes a rolling direction position of roll chocks of the reference roll as a reference position, and based on a rolling direction force difference that is a difference between a rolling direction force on the work side and a rolling direction force on the drive side, drives the driving apparatus to control positions in the rolling direction of the roll chocks of the rolls other than the reference roll so that the rolling direction force difference of each of the rolls becomes a value within an allowable range.

A roll located at a lowermost part or an uppermost part in the vertical direction among the plurality of rolls may be adopted as the reference roll.

Further, the rolling mill may be provided a bending apparatus that imparts a bending force to the rolls, the position control unit sets a roll gap between the work rolls in an open state, and imparts a bending force by means of the bending apparatus to the roll chocks of the work rolls.

The driving apparatus may be a hydraulic cylinder comprising a roll chock position detection apparatus.

Further, to solve the problem described above, according to a different aspect of the present invention there is provided a method for setting a rolling mill, the rolling mill being a rolling mill of four-high or more that includes a plurality of rolls including at least a pair of work rolls and a pair of backup rolls supporting the work rolls, the method for setting a rolling mill being executed before reduction position zero point adjustment or before starting rolling, wherein any one roll among respective rolls arranged in a vertical direction is adopted as a reference roll, the method including: measuring at least rolling direction forces in a rolling direction that act on roll chocks on a work side and roll chocks on a drive side of the rolls other than the backup rolls, and fixing a rolling direction position of roll chocks of the reference roll as a reference position, and moving roll chocks of the rolls other than the reference roll in a rolling direction of a workpiece to adjust positions of the roll chocks so that a rolling direction force difference that is a difference between a rolling direction force measured on the work side and a rolling direction force measured on the drive side falls within an allowable range.

A roll located at a lowermost part or an uppermost part in the vertical direction among the plurality of rolls may be adopted as the reference roll.

In order from a roll assembly on an opposite side to the reference roll, the roll chocks of the rolls may be moved in the rolling direction of the workpiece to adjust the positions of the roll chocks so that the rolling direction force differences arising at the rolls that are adjacent fall within an allowable range, and at such time, the roll chocks of the rolls for which the position of the roll chocks is already adjusted may be controlled simultaneously and in a same direction while maintaining relative positions with respect to the roll chocks of the roll that is being adjusted.

Further, in the rolling mill that is a four-high rolling mill, a plurality of rolls provided on an upper side in the vertical direction with respect to the workpiece are adopted as an upper roll assembly, and a plurality of rolls provided on a lower side in the vertical direction with respect to the workpiece are adopted as a lower roll assembly; the method may including performing: a first adjustment in which a roll gap between the work rolls is set in an open state, and with respect to each of the upper roll assembly and the lower roll assembly, positions of the roll chocks of the work roll and the roll chocks of the backup roll are adjusted, and after the first adjustment ends, a second adjustment in which the work rolls are set in a kiss roll state, and either one of the upper roll assembly and the lower roll assembly is adopted as a reference roll assembly, and positions of the roll chocks of each roll of the other roll assembly are adjusted by controlling the roll chocks simultaneously and in a same direction while maintaining relative positions between the roll chocks; and in the first adjustment, with respect to each of the upper roll assembly and the lower roll assembly, in a state in which a bending force is applied to the roll chocks of the work rolls having a bending apparatus, the roll chocks of the work roll on the reference roll side and either one of the roll chocks of the work roll and the roll chocks of the backup roll of the roll assembly on the opposite side to the reference roll are moved in the rolling direction of the workpiece to adjust positions of the roll chocks so that the rolling direction force difference measured falls within an allowable range.

Further, in the rolling mill that is a six-high rolling mill comprising intermediate rolls between the work rolls and the backup rolls, respectively, a plurality of rolls provided on an upper side in the vertical direction with respect to the workpiece are adopted as an upper roll assembly, and a plurality of rolls provided on a lower side in the vertical direction with respect to the workpiece are adopted as a lower roll assembly; the method may including performing: a first adjustment in which a roll gap between the work rolls is set in an open state, and with respect to each of the upper roll assembly and the lower roll assembly, positions of the roll chocks of the intermediate roll and the roll chocks of the backup roll are adjusted, after the first adjustment ends, a second adjustment in which the roll gap between the work rolls is maintained in an open state, and with respect to each of the upper roll assembly and the lower roll assembly, positions of the roll chocks of the intermediate roll and the roll chocks of the work roll are adjusted, and after the second adjustment ends, a third adjustment in which the work rolls are set in a kiss roll state, either one of the upper roll assembly and the lower roll assembly is adopted as a reference roll assembly, and positions of the roll chocks of each roll of the other roll assembly are adjusted by controlling the roll chocks simultaneously and in a same direction while maintaining relative positions between the roll chocks; wherein, the first adjustment and the second adjustment are performed in a state in which a bending force is applied to the roll chocks of the intermediate rolls and the roll chocks of the work rolls that have a bending apparatus; in the first adjustment, with respect to each of the upper roll assembly and the lower roll assembly, the roll chocks of the intermediate roll on the reference roll side and either one of the roll chocks of the intermediate roll and the roll chocks of the backup roll of the roll assembly on the opposite side to the reference roll are moved in the rolling direction of the workpiece to adjust positions of the roll chocks so that the rolling direction force differences measured fall within an allowable range; and in the second adjustment, with respect to each of the upper roll assembly and the lower roll assembly, the roll chocks of the work roll on the reference roll side and either one of the roll chocks of the work roll and the roll chocks of the intermediate roll of the roll assembly on the opposite side to the reference roll are moved in the rolling direction of the workpiece to adjust positions of the roll chocks so that the rolling direction force differences measured fall within an allowable range, and in a case of moving the roll chocks of the intermediate roll of the roll assembly on the opposite side to the reference roll, the roll chocks of the intermediate roll and the roll chocks of the backup roll that is adjacent to the intermediate roll are controlled simultaneously and in a same direction while maintaining relative positions between the roll chocks of the intermediate roll and the roll chocks of the backup roll.

Advantageous Effects of Invention

As described above, according to the present invention, thrust forces generated between rolls can be reduced and the occurrence of zigzagging and camber of a workpiece can be suppressed.

DESCRIPTION OF EMBODIMENTS

Figure 1:
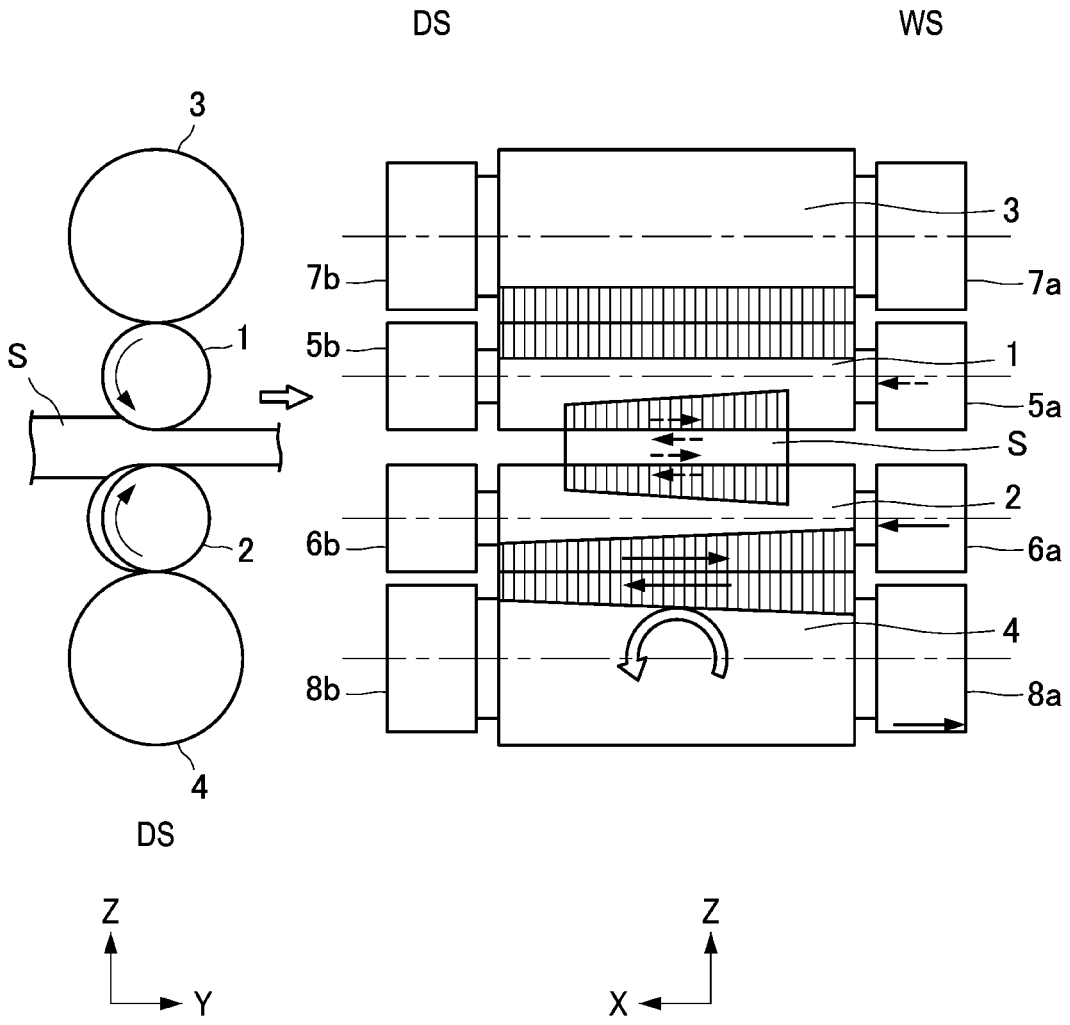
FIG. 1 is a multiple view drawing including a schematic side view and a schematic front view of a rolling mill for describing a thrust force and a thrust counterforce which are generated between rolls of a rolling mill during rolling.

Hereunder, preferred embodiments of the present invention are described in detail while referring to the accompanying drawings. Note that, in the present specification and the accompanying drawings, constituent elements having substantially the same functional configuration are denoted by the same reference characters and a duplicate description thereof is omitted.

1. Objective

An objective of a rolling mill as well as a method for setting the rolling mill according to the embodiments of the present invention is to eliminate thrust forces generated between rolls, and enable the stable production of products without zigzagging and camber or with extremely little zigzagging and camber. In FIG. 1, a schematic side view and a schematic front view of a rolling mill are illustrated for describing a thrust force and a thrust counterforce which are generated between rolls of a rolling mill during rolling of a workpiece S. Hereunder, as illustrated in FIG. 1, the work side in the axial direction of rolls is represented by "WS", and the drive side is represented by "DS".

The rolling mill illustrated in FIG. 1 has a pair of work rolls consisting of an upper work roll 1 and a lower work roll 2, and a pair of backup rolls consisting of an upper backup roll 3 that supports the upper work roll 1 in the vertical direction (Z direction) and a lower backup roll 4 that supports the lower work roll 2 in the vertical direction. The work side of the upper work roll 1 is supported by an upper work roll chock 5*a*, and the drive side of the upper work roll 1 is supported by an upper work roll chock 5*b*. The work side of the lower work roll 2 is supported by a lower work roll chock 6*a*, and the drive side of the lower work roll 2 is supported by a lower work roll chock 6*b*. Similarly, the work side of the upper backup roll 3 is supported by an upper backup roll chock 7*a*, and the drive side of the upper backup roll 3 is supported by an upper backup roll chock 7*b*. The work side of the lower backup roll 4 is supported by a lower backup roll chock 8*a*, and the drive side of the lower backup roll 4 is supported by a lower backup roll chock 8*b*.

The upper work roll 1, the lower work roll 2, the upper backup roll 3 and the lower backup roll 4 are arranged in a manner in which the axial directions of the respective rolls are parallel, so as to be orthogonal with the conveyance direction of the workpiece S. However, if a roll rotates slightly about an axis (Z-axis) that is parallel with the vertical direction and a deviation arises between the axial directions of the upper work roll 1 and the upper backup roll 3, or a deviation arises between the axial directions of the lower work roll 2 and the lower backup roll 4, a thrust force that acts in the axial direction of the rolls arises between the work roll and the backup roll. An inter-roll thrust force gives an extra moment to the rolls, and causes asymmetric roll deformation to occur due to the aforementioned moment. The asymmetric roll deformation is a factor that causes the rolling to enter an unstable state, and for example gives rise to zigzagging or camber. The inter-roll thrust force is generated as a result of an inter-roll cross angle arising due to the occurrence of a deviation between the axial directions of a work roll and a backup roll. For example, let us assume that an inter-roll cross angle arises between the lower work roll 2 and the lower backup roll 4. At such time, a thrust force is generated between the lower work roll 2 and the lower backup roll 4, and as a result, a moment occurs at the lower backup roll 4, and the load distribution between the rolls changes to balance with the moment, and thus an asymmetric roll deformation occurs. Zigzagging or camber or the like is caused by the asymmetric roll deformation, and the rolling becomes unstable.

As described above, an objective of the present invention is, during rolling of a workpiece by a rolling mill, to adjust roll chock positions of each roll so that inter-roll thrust forces generated between rolls are eliminated, based on a left-right difference in rolling direction forces before reduction position zero point adjustment or before the start of rolling, and thereby enable the stable production of products without zigzagging and camber or with extremely little zigzagging and camber.

2. First Embodiment

The configuration of a rolling mill according to a first embodiment of the present invention and an apparatus for controlling the rolling mill, as well as a method for setting a rolling mill will be described based on FIG. 2A to FIG. 4. In the first embodiment, before reduction position zero point adjustment or before the start of rolling, the positions of roll chocks are adjusted so as to make an inter-roll cross angle between a backup roll serving as a reference and other rolls zero, to thereby realize rolling in which thrust forces do not arise.

[2-1. Configuration of Rolling Mill]

Figure 2A:
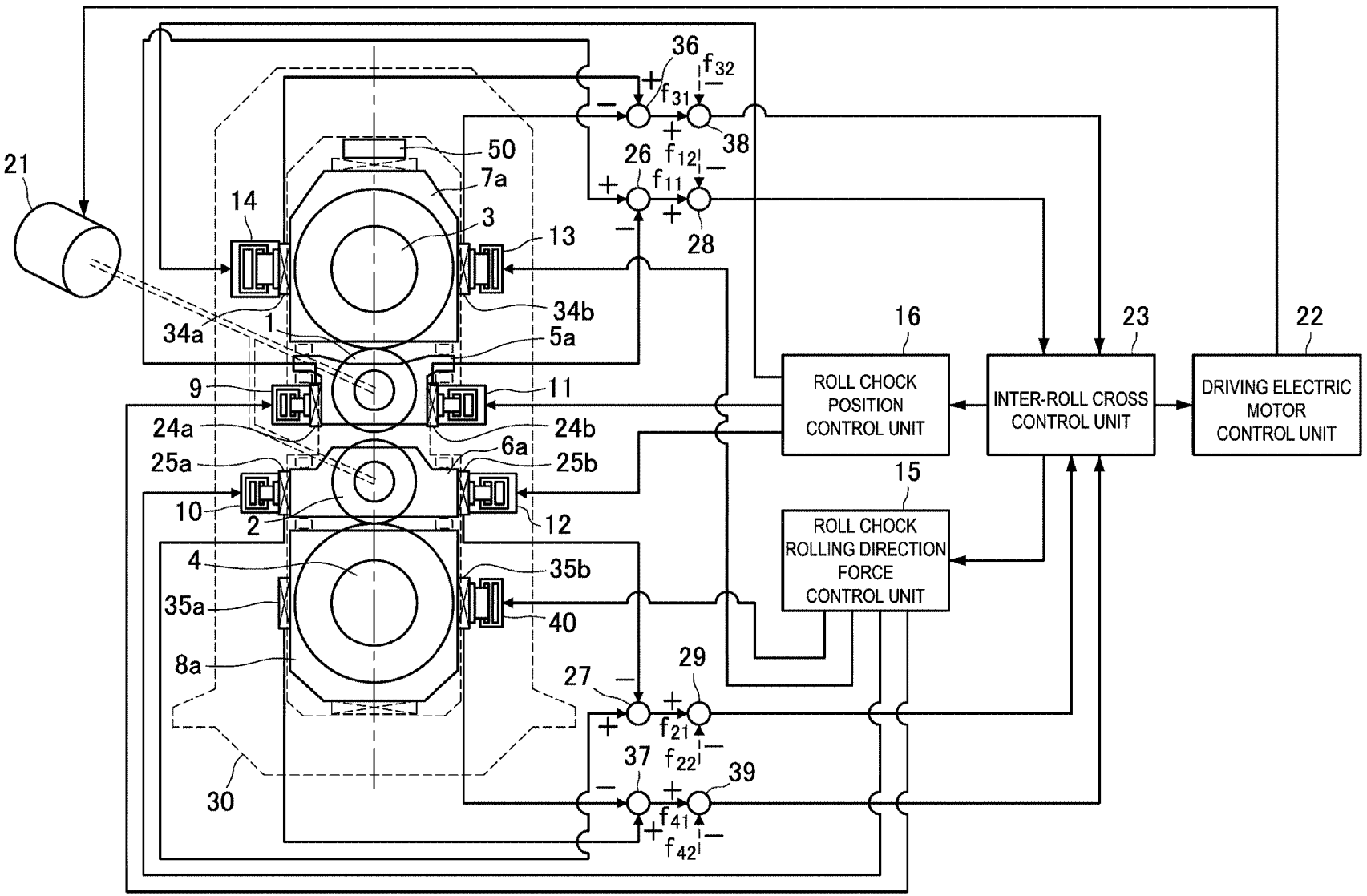
FIG. 2A is an explanatory drawing illustrating the configuration of a rolling mill according to a first embodiment of the present invention, and an apparatus for controlling the rolling mill.
Figure 2B:
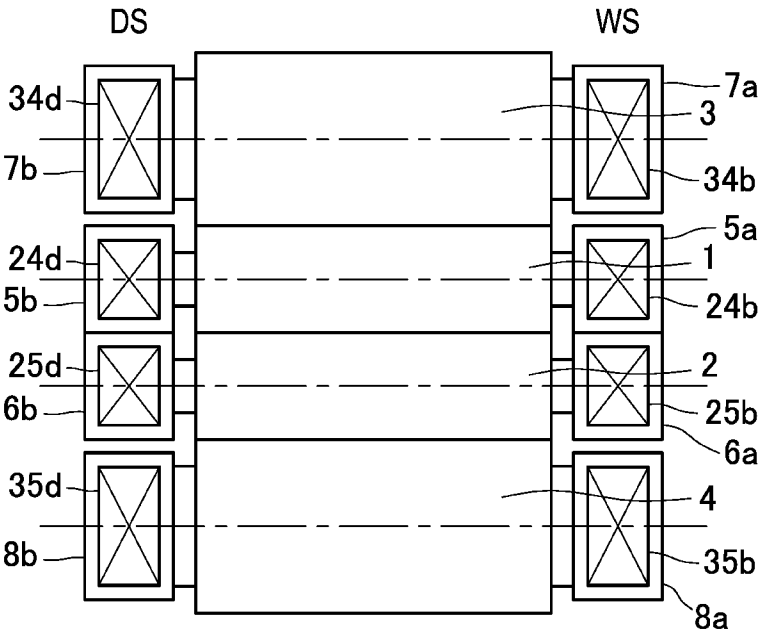
FIG. 2B is an explanatory drawing illustrating rolling direction force measurement apparatuses that are arranged on an entrance side and an exit side of the rolling mill illustrated in FIG. 2A.
Figure 2B:
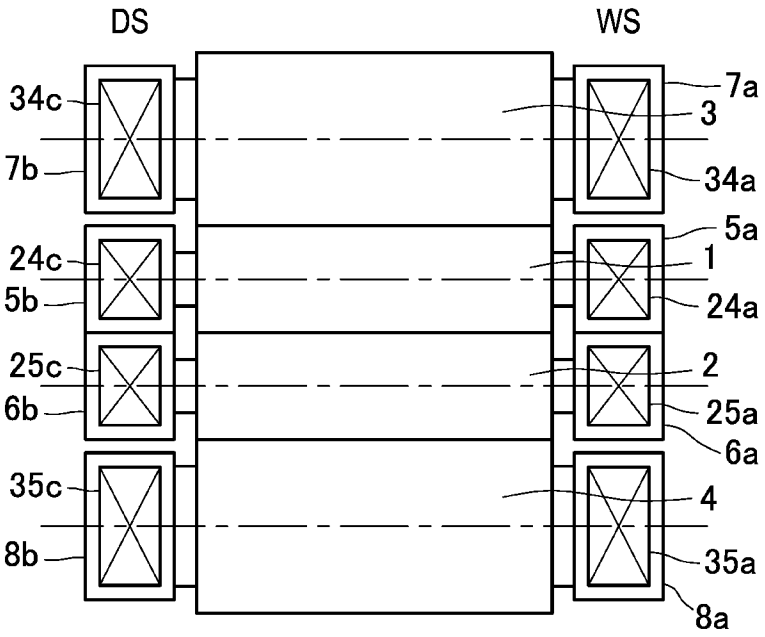

First, the rolling mill according to the present embodiment and an apparatus for controlling the rolling mill will be described based on FIG. 2A and FIG. 2B. FIG. 2A is an explanatory drawing illustrating the configuration of the rolling mill according to the present embodiment, and an apparatus for controlling the rolling mill. FIG. 2B is an explanatory drawing illustrating rolling direction force measurement apparatuses that are arranged on an entrance side and an exit side of the rolling mill illustrated in FIG. 2A. Note that, it is assumed that the rolling mill illustrated in FIG. 2A is shown in a state as seen from the work side in the axial direction of the rolls. Further, in FIG. 2A, a configuration in a case where the lower backup roll is adopted as the reference roll is illustrated. Note that, the reference roll is preferably a roll for which the area of contact between the chocks and the housing is large, and which is located at the lowermost part or the uppermost part, where the position is stable.

The rolling mill illustrated in FIG. 2A is a four-high rolling mill having a pair of work rolls 1 and 2 and a pair of backup rolls 3 and 4 that support the pair of work rolls 1 and 2. In the four-high rolling mill, the upper work roll 1, the lower work roll 2, the upper backup roll 3 and the lower backup roll 4 are a plurality of rolls which are arranged in the vertical direction. The upper work roll 1 and the lower work roll 2 are rotationally driven by a driving electric motor 21. As illustrated in FIG. 2B, the upper work roll 1 is supported by upper work roll chocks 5*a* and 5*b*, and the lower work roll 2 is supported by lower work roll chocks 6*a* and 6*b*. Although only the upper work roll chock 5*a* and the lower work roll chock 6*a* on the work side are illustrated in FIG. 2A, the upper work roll chock 5*b* and the lower work roll chock 6*b* that are illustrated in FIG. 2B are provided on the drive side that is on the side facing away from the viewer in FIG. 2A. As illustrated in FIG. 2B, the upper work roll chocks 5*a* and 5*b*, the lower work roll chocks 6*a* and 6*b*, the upper backup roll chocks 7*a* and 7*b* and the lower backup roll chocks 8*a* and 8*b* are provided with rolling direction force measurement apparatuses 24*a* to 24*d*, 25*a* to 25*d*, 34*a* to 34*d* and 35*a* to 35*d* which detect a load in the rolling direction, respectively. The rolling direction force measurement apparatuses 24*a*, 24*c*, 25*a*, 25*c*, 34*a*, 34*c*, 35*a* and 35*c* are provided on the entrance side of the respective roll chocks, and the rolling direction force measurement apparatus 24*b*, 24*d*, 25*b*, 25*d*, 34*b*, 34*d*, 35*b* and 35*d* are provided on the exit side of the respective roll chocks. Note that, the upper work roll chocks 5, the lower work roll chocks 6, the upper backup roll chocks 7 and the lower backup roll chocks 8 are sometimes referred to as simply "roll chocks". Further, the rolling direction force measurement apparatuses 24*a* to 24*d*, 25*a* to 25*d*, 34*a* to 34*d* and 35*a* to 35*d* are likewise sometimes referred to as simply "measurement apparatuses".

The upper backup roll 3 is supported by the upper backup roll chocks 7*a* and 7*b*, and the lower backup roll 4 is supported by the lower backup roll chocks 8*a* and 8*b*. Although only the upper backup roll chock 7*a* and the lower backup roll chock 8*a* on the work side are illustrated in FIG. 2A, the upper backup roll chock 7*b* and the lower backup roll chock 8*b* that are illustrated in FIG. 2B are provided on the drive side that is on the side facing away from the viewer in FIG. 2A. The upper work roll chocks 5*a* and 5*b*, the lower work roll chocks 6*a* and 6*b*, the upper backup roll chocks 7*a* and 7*b*, and the lower backup roll chocks 8*a* and 8*b* are retained by a housing 30.

The upper work roll chocks 5*a* and 5*b* are provided with an upper work roll chock pressing apparatus 9 which is provided on the entrance side in the rolling direction and which presses the upper work roll chocks 5*a* and 5*b* in the rolling direction, and a driving apparatus with upper work roll chock position detection function 11 which is provided on the exit side in the rolling direction and which detects the position in the rolling direction and drives the upper work roll chocks 5*a* and 5*b* in the rolling direction. Further, the rolling direction force measurement apparatuses 24*a* to 24*d* which measure rolling direction forces applied to the upper work roll 1 are provided in the upper work roll 1.

Similarly, the lower work roll chocks 6*a* and 6*b* are provided with a lower work roll chock pressing apparatus 10 which is provided on the entrance side in the rolling direction and which presses the lower work roll chocks 6*a* and 6*b* in the rolling direction, and a driving apparatus with lower work roll chock position detection function 12 which is provided on the exit side in the rolling direction and which detects the position in the rolling direction and drives the lower work roll chocks 6*a* and 6*b* in the rolling direction. For example, a hydraulic cylinder is used as the driving apparatus with upper work roll chock position detection function 11, the driving apparatus with lower work roll chock position detection function 12, a drive mechanism of the upper work roll chock pressing apparatus 9 and a drive mechanism of the lower work roll chock pressing apparatus 10. Note that, whilst the upper and lower driving apparatuses with work roll chock position detection function 11 and 12 and the upper and lower work roll chock pressing apparatuses 9 and 10 are shown only on the work side in FIG. 2A, these apparatuses are also similarly provided on the side facing away from the viewer (drive side) in FIG. 2A.

The upper backup roll chocks 7*a* and 7*b* are provided with an upper backup roll chock pressing apparatus 13 which is provided on the exit side in the rolling direction and which presses the upper backup roll chocks 7*a* and 7*b* in the rolling direction, and a driving apparatus with upper backup roll chock position detection function 14 which is provided on the entrance side in the rolling direction and which detects the position in the rolling direction and drives the upper backup roll chocks 7*a* and 7*b* in the rolling direction. For example, a hydraulic cylinder is used as the driving apparatus with upper backup roll chock position detection function 14 and the drive mechanism of the upper backup roll chock pressing apparatus 13. Note that, whilst the driving apparatus with upper backup roll chock position detection function 14 and the upper backup roll chock pressing apparatus 13 are shown only on the work side in FIG. 2A, these apparatuses are also similarly provided on the side facing away from the viewer (drive side) in FIG. 2A.

On the other hand, with respect to the lower backup roll chocks 8*a* and 8*b*, since the lower backup roll 4 is adopted as the reference roll in the present embodiment, the lower backup roll chocks 8*a* and 8*b* serve as reference backup roll chocks. Accordingly, since the lower backup roll chocks 8*a* and 8*b* are not driven to perform position adjustment, the lower backup roll chocks 8*a* and 8*b* do not necessarily need to be equipped with a driving apparatus and a position detection apparatus as in the case of the upper backup roll chocks 7*a* and 7*b*. However, a configuration may be adopted in which, for example, a lower backup roll chock pressing apparatus 40 or the like is provided on the entrance side or the exit side in the rolling direction to suppress the occurrence of looseness of the lower backup roll chocks 8*a* and 8*b* so that the position of the reference backup roll chocks that serve as the reference for position adjustment does not change. Note that, whilst the lower backup roll chock pressing apparatus 40 is shown only on the work side in FIG. 2A, this apparatus is also similarly provided on the side facing away from the viewer (drive side) in FIG. 2A.

The upper work roll chock pressing apparatus 9, the lower work roll chock pressing apparatus 10, the upper backup roll chock pressing apparatus 13 and the lower backup roll chock pressing apparatus 40 are provided on either one of the entrance side and the exit side in the rolling direction of the workpiece, and are pressing apparatuses that press the roll chocks in the rolling direction, and are sometimes referred to as simply "pressing apparatuses". It suffices that the pressing apparatuses are provided with respect to at least the roll chocks of the rolls other than the reference roll. Further, the driving apparatus with upper work roll chock position detection function 11, the driving apparatus with lower work roll chock position detection function 12 and the driving apparatus with upper backup roll chock position detection function 14 are provided so as to face the pressing apparatuses in the rolling direction, and are driving apparatuses that move the roll chocks in the rolling direction, and are sometimes referred to as simply "driving apparatuses". It suffices that the driving apparatuses also are provided with respect to at least the roll chocks of the rolls other than the reference roll.

As apparatuses for controlling the rolling mill, for example, as illustrated in FIG. 2A, the configuration includes a roll chock rolling direction force control unit 15, a roll chock position control unit 16, a driving electric motor control unit 22 and an inter-roll cross control unit 23.

The roll chock rolling direction force control unit 15 controls a pressing force in the rolling direction of the upper work roll chock pressing apparatus 9, the lower work roll chock pressing apparatus 10, the upper backup roll chock pressing apparatus 13 and the lower backup roll chock pressing apparatus 40. Based on a control instruction of the inter-roll cross control unit 23 that is described later, the roll chock rolling direction force control unit 15 drives the upper work roll chock pressing apparatus 9, the lower work roll chock pressing apparatus 10, and the upper backup roll chock pressing apparatus 13 that are control objects with respect to chock positions to thereby produce a state in which it is possible to control the chock positions by application of a predetermined pressing force.

The roll chock position control unit 16 performs drive control of the driving apparatus with upper work roll chock position detection function 11, the driving apparatus with lower work roll chock position detection function 12 and the driving apparatus with upper backup roll chock position detection function 14. The roll chock position control unit 16 is also referred to as simply "position control unit". Based on a control instruction of the inter-roll cross control unit 23, the roll chock position control unit 16 drives the driving apparatus with upper work roll chock position detection function 11, the driving apparatus with lower work roll chock position detection function 12 and the driving apparatus with upper backup roll chock position detection function 14 so that a rolling direction force difference that is a difference between a rolling direction force acting on the roll chocks on the work side and a rolling direction force acting on the roll chocks on the drive side is within a predetermined range. The driving apparatuses with position detection functions 11, 12 and 14 are disposed on both the work side and the drive side, and with respect to the positions in the rolling direction on the work side and the drive side, by controlling the driving apparatuses with position detection functions 11, 12 and 14 so that the positions change by the same amount in opposite directions on the work side and the drive side, can change a roll cross angle only, without changing the average rolling direction position of the work side and drive side.

The driving electric motor control unit 22 controls the driving electric motor 21 that rotationally drives the upper work roll 1 and the lower work roll 2. The driving electric motor control unit 22 according to the present embodiment controls driving of the upper work roll 1 or the lower work roll 2 based on an instruction from the inter-roll cross control unit 23.

The inter-roll cross control unit 23 controls the position of each of the upper work roll 1, the lower work roll 2, the upper backup roll 3 and the lower backup roll 4 constituting the rolling mill by adjusting the positions of the roll chocks, so that an inter-roll cross angle is zero. In the rolling mill according to the present embodiment, the positions of the roll chocks are adjusted by making a difference (rolling direction force difference) between a rolling direction force acting on roll chocks on the work side and a rolling direction force acting on roll chocks on the drive side become a value within a predetermined range.

With regard to the upper work roll chock 5*a* on the work side, a difference between a rolling direction force measured by the entrance-side rolling direction force measurement apparatus 24*a* and a rolling direction force measured by the exit-side rolling direction force measurement apparatus 24*b* on the work side is calculated by an upper work roll work-side rolling direction force calculation apparatus 26, and is taken as the rolling direction force on the work side of the upper work roll 1. Similarly, a difference between a rolling direction force measured by the entrance-side rolling direction force measurement apparatus 24*c* and a rolling direction force measured by the exit-side rolling direction force measurement apparatus 24*d* on the drive side is calculated by an upper work roll drive-side rolling direction force calculation apparatus (not illustrated in the drawings), and is taken as the rolling direction force on the drive side of the upper work roll 1. Further, a difference between a calculated value $f_{11}$ of the rolling direction force on the work side and a calculated value $f_{12}$ of the rolling direction force on the drive side of the upper work roll 1 is calculated by an upper work roll work side-drive side difference calculation apparatus 28 to thereby calculate a rolling direction force difference acting on the upper work roll chocks 5*a* and 5*b*.

With regard to the lower work roll chock 6*a* on the work side, a difference between a rolling direction force measured by the entrance-side rolling direction force measurement apparatus 25*a* and a rolling direction force measured by the exit-side rolling direction force measurement apparatus 25*b* on the work side is calculated by a lower work roll work-side rolling direction force calculation apparatus 27, and is taken as the rolling direction force on the work side of the lower work roll 2. Similarly, a difference between a rolling direction force measured by the entrance-side rolling direction force measurement apparatus 25*c* and a rolling direction force measured by the exit-side rolling direction force measurement apparatus 25*d* on the drive side is calculated by a lower work roll drive-side rolling direction force calculation apparatus (not illustrated in the drawings), and is taken as the rolling direction force on the drive side of the lower work roll 2. Further, a difference between a calculated value $f_{21}$ of the rolling direction force on the work side and a calculated value $f_{22}$ of the rolling direction force on the drive side of the lower work roll 2 is calculated by a lower work roll work side-drive side difference calculation apparatus 29 to thereby calculate a rolling direction force difference acting on the lower work roll chocks 6*a* and 6*b*.

With regard to the upper backup roll chock 7*a* on the work side, a difference between a rolling direction force measured by the entrance-side rolling direction force measurement apparatus 34*a* and a rolling direction force measured by the exit-side rolling direction force measurement apparatus 34*b* on the work side is calculated by an upper backup roll work-side rolling direction force calculation apparatus 36, and is taken as the rolling direction force on the work side of the upper backup roll 3. Similarly, a difference between a rolling direction force measured by the entrance-side rolling direction force measurement apparatus 34*c* and a rolling direction force measured by the exit-side rolling direction force measurement apparatus 34*d* on the drive side is calculated by an upper backup roll drive-side rolling direction force calculation apparatus (not illustrated in the drawings), and is taken as the rolling direction force on the drive side of the upper backup roll 3. Further, a difference between a calculated value $f_{31}$ of the rolling direction force on the work side and a calculated value $f_{32}$ of the rolling direction force on the drive side of the upper backup roll 3 is calculated by an upper backup roll work side-drive side difference calculation apparatus 38 to thereby calculate a rolling direction force difference acting on the upper backup roll chocks 7*a* and 7*b*.

With regard to the lower backup roll chock 8*a* on the work side, a difference between a rolling direction force measured by the entrance-side rolling direction force measurement apparatus 35*a* and a rolling direction force measured by the exit-side rolling direction force measurement apparatus 35*b* on the work side is calculated by a lower backup roll work-side rolling direction force calculation apparatus 37, and is taken as the rolling direction force on the work side of the lower backup roll 4. Similarly, a difference between a rolling direction force measured by the entrance-side rolling direction force measurement apparatus 35*c* and a rolling direction force measured by the exit-side rolling direction force measurement apparatus 35*d* on the drive side is calculated by a lower backup roll drive-side rolling direction force calculation apparatus (not illustrated in the drawings), and is taken as the rolling direction force on the drive side of the lower backup roll 4. Further, a difference between a calculated value $f_{41}$ of the rolling direction force on the work side and a calculated value $f_{42}$ of the rolling direction force on the drive side of the lower backup roll 4 is calculated by a lower backup roll work side-drive side difference calculation apparatus 39 to thereby calculate a rolling direction force difference acting on the lower backup roll chocks 8*a* and 8*b*.

Based on the rolling direction force differences calculated by the upper work roll work side-drive side difference calculation apparatus 28, the lower work roll work side-drive side difference calculation apparatus 29, the upper backup roll work side-drive side difference calculation apparatus 38 and the lower backup roll work side-drive side difference calculation apparatus 39, the inter-roll cross control unit 23 issues control instructions to the roll chock rolling direction force control unit 15, the roll chock position control unit 16 and the driving electric motor control unit 22 so that the rolling direction force differences become values that are not more than an allowable range, so that crosses that occurred between the rolls are eliminated. Note that the details of the method for setting the rolling mill are described later.

Although an example has been described above in which, with respect to the work roll chocks 5 and 6, the driving apparatuses with position detection functions 11 and 12 are arranged on the exit side and the pressing apparatuses 9 and 10 are arranged on the entrance side of the rolling mill, and with respect to the backup roll chocks 7, the driving apparatus with position detection function 14 is arranged on the entrance side and the pressing apparatus 13 is arranged on the exit side of the rolling mill, the present invention is not limited to this example. For example, the arrangement of these apparatuses with respect to the entrance side and the exit side of the rolling mill may be the reverse of the arrangement in the above example, or these apparatuses may be installed in the same direction with respect to the work rolls and the backup rolls. In addition, with regard to the driving apparatuses with position detection functions 11, 12 and 14, whilst an example has been described in which these apparatuses are provided on both the work side and the drive side and the respective apparatuses are subjected to position control, the present invention is not limited to this example. These apparatuses may be provided on only one side among the work side and the drive side, or alternatively it is possible to adopt a configuration so that only the apparatuses provided on one side are actuated and to control a roll cross angle by performing position control by taking the opposite side thereto as the support point of rotation, and it need scarcely be said that the same effect of reducing an inter-roll cross is obtained.

Further, whilst an example has been described above in which all of the rolls are provided with a rolling direction force measurement apparatus, the present invention is not limited to this example. For example, it is possible to perform similar control even in a case where only the upper work roll rolling direction force measurement apparatuses 24*a* to 24*d* and the lower work roll rolling direction force measurement apparatuses 25*a* to 25*d* are provided, or a case where the upper backup roll rolling direction force measurement apparatuses 34*a* to 34*d* or the lower backup roll rolling direction force measurement apparatuses 35*a* to 35*d* are also provided in addition to the aforementioned measurement apparatuses 24*a* to 24*d* and 25*a* to 25*d*. The control procedures for such cases are described later.

Furthermore, whilst an example has been described above in which rolling direction force measurement apparatuses are provided on both the entrance side and the exit side, the present invention is not limited to this example. For example, in a case where work rolls are offset in the rolling direction on one side among the entrance side and the exit side of the rolling mill, or a case where the force of the roll chock pressing apparatuses is large and rolling direction forces act only in the direction of one side among the entrance side and the exit side of the rolling mill, control can be similarly performed by providing the rolling direction force measurement apparatuses on one side among the entrance side and the exit side that is the side in the direction in which the rolling direction forces act, and calculating the differences between the work side and the drive side of these rolling direction forces that act on one side.

In addition, whilst an example has been described above in which a driving apparatus with a position detection function is provided on the work side and the drive side for all of the rolls except the reference roll, the present invention is not limited to this example. For example, all of the rolls may be provided with a driving apparatus with a position detection function, and the reference roll may be changed according to the situation, and control may be performed based on the changed reference roll. Alternatively, a driving apparatus with a position detection function may be provided on either one side among the work side and the drive side, with the opposite side being taken as a pivot, and the inter-roll cross angle may be similarly controlled by controlling only the roll chock positions on one side.

[2-2. Method for Setting Rolling Mill]

Figure 3A:
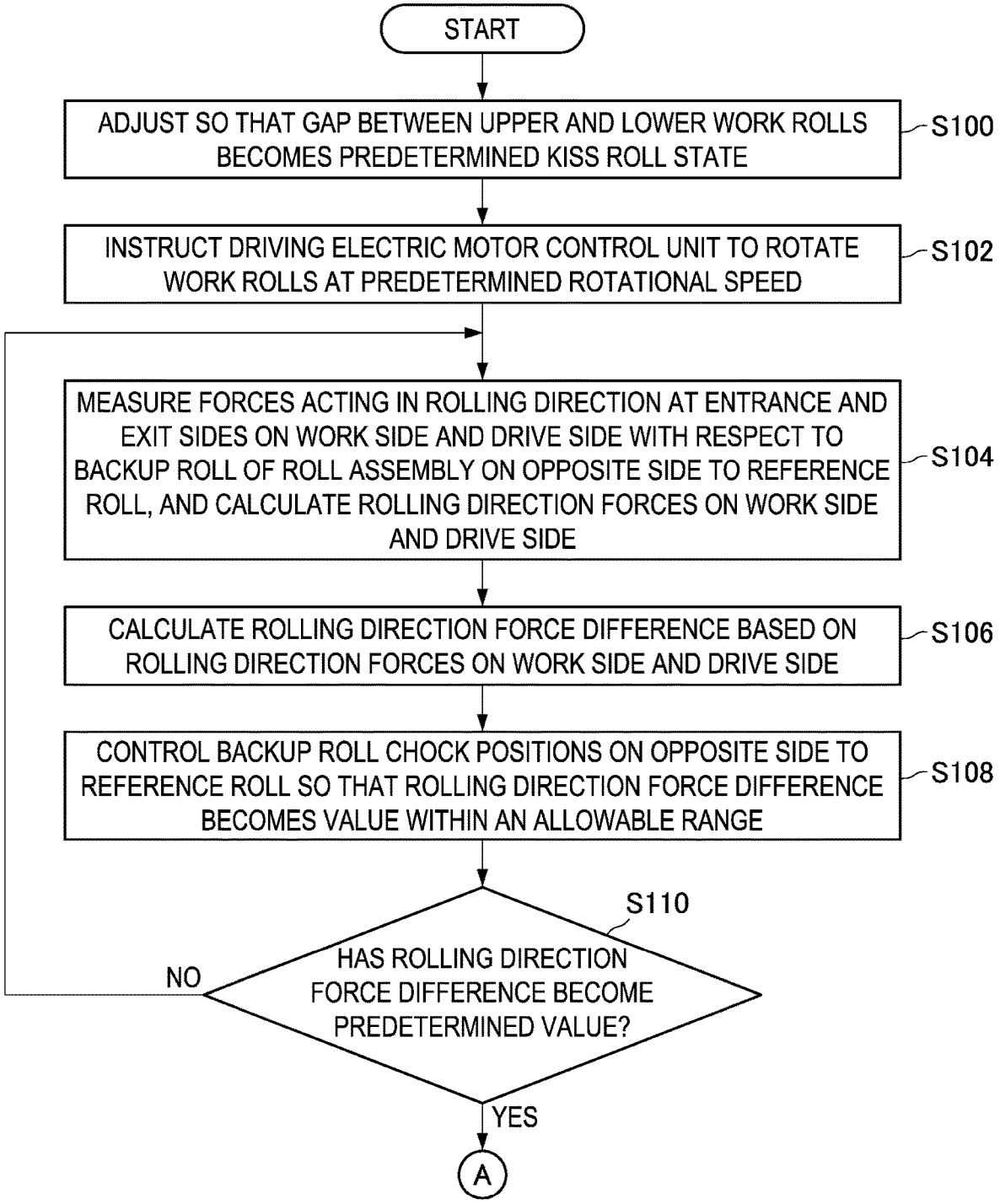
FIG. 3A is a flowchart describing a method for setting a rolling mill according to the first embodiment, which illustrates an example of a case of performing position adjustment from a roll on an opposite side to a reference roll.
Figure 3B:
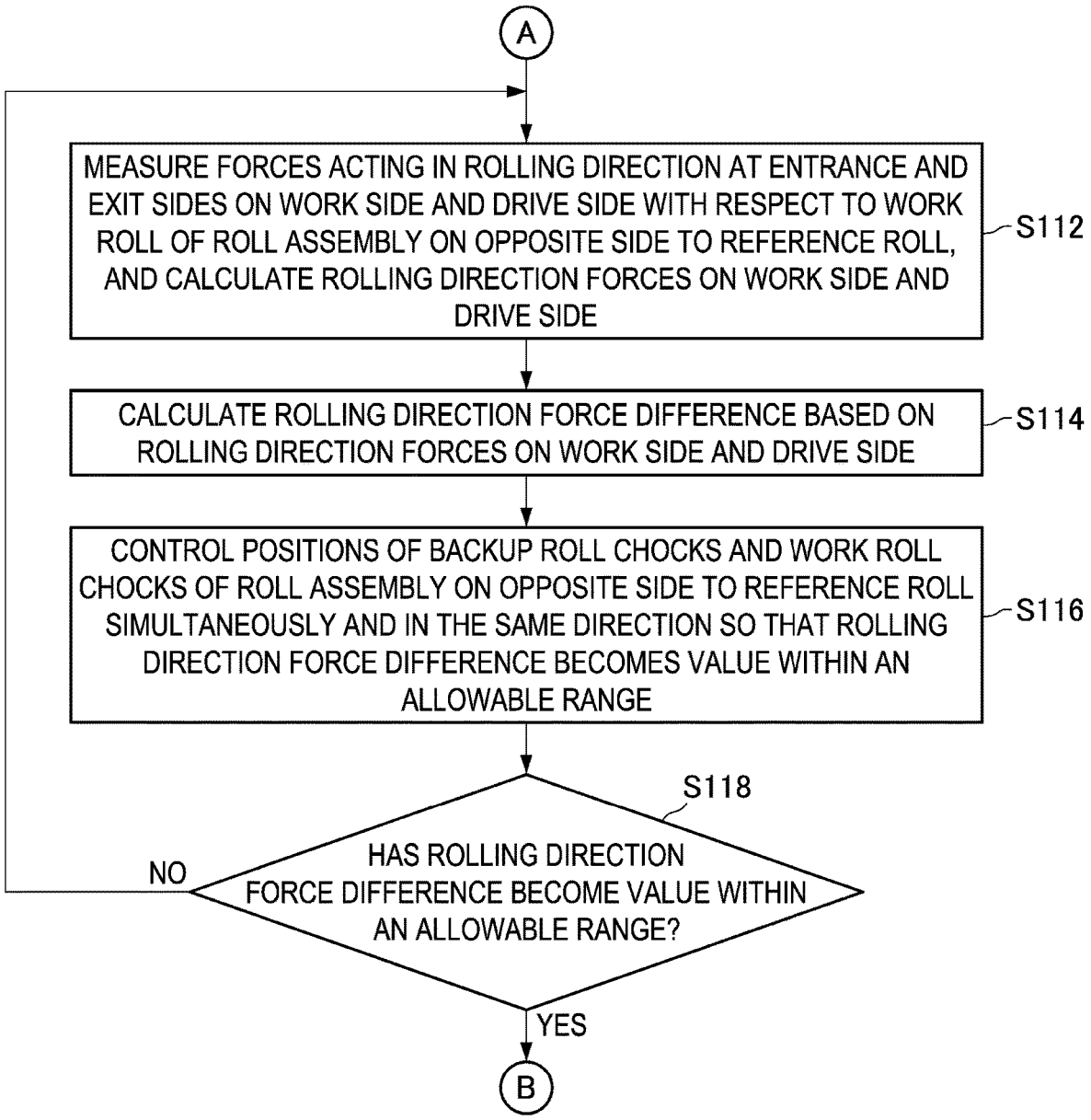
FIG. 3B is a flowchart describing a method for setting a rolling mill according to the first embodiment, which illustrates an example of a case of performing position adjustment from a roll on an opposite side to a reference roll.

The method for setting a rolling mill according to the present embodiment will now be described based on FIG. 3A to FIG. 4. The method for setting a rolling mill according to the present embodiment is a method which is executed before reduction position zero point adjustment or before the start of rolling, and which adjusts the positions of roll chocks from a roll on an opposite side to a reference roll, and in which rolling direction force differences of all the rolls are measured in order to perform position adjustment of the roll chocks. FIG. 3A to FIG. 3C are flowcharts for describing the method for setting a rolling mill according to the present embodiment, and show an example of a case of performing position adjustment from a roll on the opposite side to the reference roll. FIG. 4 is an explanatory drawing showing procedures for roll position adjustment in the method for setting a rolling mill according to the present embodiment. Note that, in FIG. 4, a description of the distribution of loads acting between rolls is omitted, and a situation is described in which only inter-roll thrust forces that are the target appear as measurement values of the rolling direction forces.

Although in the following description the lower backup roll 4 is described as the reference roll, in the present embodiment it suffices to set either the roll at the uppermost part or the roll at the lowermost part in the vertical direction as the reference roll, and in some cases the upper backup roll 3 serves as the reference roll. In this case also, by similar procedures as described hereunder, it suffices to perform position adjustment of rolls in order from the roll assembly on the opposite side to the reference roll in a manner such that, first, position adjustment is performed between the roll (lower backup roll 4) that is furthest from the reference roll (upper backup roll 3) and the roll (lower work roll 2) that is second furthest from the reference roll, followed by position adjustment between the aforementioned two rolls and the roll (upper work roll 1) that is third furthest from the reference roll, and finally position adjustment between the aforementioned three rolls and the reference roll.

(Initial Setting: S100, S102)

As shown in FIG. 3A, first, the inter-roll cross control unit 23 outputs an instruction to a pressing-down device 50 to adjust roll positions in the vertical direction so that the upper work roll 1 and the lower work roll 2 enter a predetermined kiss roll state (S100). The pressing-down device 50 applies a predetermined load to the rolls based on the instruction to thereby set the work rolls 1 and 2 in a kiss roll state. Further, the inter-roll cross control unit 23 instructs the driving electric motor control unit 22 so as to cause the upper work roll 1 and the lower work roll 2 to rotate at a predetermined rotational speed (S102).

Next, position adjustment of the respective rolls is performed in a stepwise manner. At such time, the rolling direction position of the roll chocks of the reference roll is fixed as a reference position, and the positions in the rolling direction of the roll chocks of the rolls other than the reference roll are moved to thereby adjust the positions of the roll chocks.

(First Adjustment: S104 to S110)

In the first adjustment, as illustrated in FIG. 4, the positions of the upper backup roll chocks 7*a* and 7*b* are adjusted so that a rolling direction force difference acting on the upper backup roll 3 that is in the roll assembly on the opposite side to the lower backup roll 4 that is the reference roll becomes zero (P11). Therefore, first, the inter-roll cross control unit 23 drives the driving electric motor 21 by means of the driving electric motor control unit 22 to cause the respective rolls to rotate. Next, rolling direction forces acting on the upper backup roll 3 are measured by the rolling direction force measurement apparatuses 34*a* to 34*d* (S104). Upon the rolling direction forces on the entrance side and the exit side of the upper backup roll chocks 7*a* and 7*b* that are on the work side being measured by the rolling direction force measurement apparatuses 34*a* and 34*b*, the rolling direction force acting on the work side of the upper backup roll 3 is calculated by the upper backup roll work-side rolling direction force calculation apparatus 36. Further, upon the rolling direction forces on the entrance side and the exit side of the upper backup roll chocks 7*a* and 7*b* that are on the drive side being measured by the rolling direction force measurement apparatuses 34*c* and 34*d*, the rolling direction force acting on the drive side of the upper backup roll 3 is calculated by the upper backup roll drive-side rolling direction force calculation apparatus (not illustrated in the drawings). Subsequently, a rolling direction force difference acting on the upper backup roll 3 that is the difference between the rolling direction force on the work side and the rolling direction force on the drive side of the upper backup roll 3 is calculated by the upper backup roll work side-drive side difference calculation apparatus 38 (S106). The rolling direction force difference acting on the upper backup roll 3 is output to the inter-roll cross control unit 23.

Next, the inter-roll cross control unit 23 controls the positions of the upper backup roll chocks 7*a* and 7*b* so that the measured rolling direction force difference acting on the upper backup roll 3 falls within an allowable range (S108). The upper and lower limit values with respect to the values in an allowable range of the rolling direction force difference may be determined after performing roll deformation analysis under kiss roll conditions, and converting an asymmetric deformation amount into a reduction leveling amount. For example, it suffices to calculate upper and lower limit values within an allowable range of a roll cross angle based on an existing rolling model in which a limit value of camber that is required for a product or a limit value of camber at which tail crash occurs is taken as a reference.

The inter-roll cross control unit 23 instructs the roll chock rolling direction force control unit 15 and the roll chock position control unit 16 so as to adjust the positions of the upper backup roll chocks 7*a* and 7*b* so that the rolling direction force difference falls within the allowable range. While detecting the positions of the upper backup roll chocks 7*a* and 7*b* by means of the roll chock position control unit 16, the positions of the upper backup roll chocks 7*a* and 7*b* are adjusted by the roll chock rolling direction force control unit 15 until the rolling direction force difference acting on the upper backup roll 3 falls within the allowable range (S110).

Subsequently, in step S110, when it is determined that the rolling direction force difference acting on the upper backup roll 3 is within the allowable range, position adjustment of the upper backup roll chocks 7*a* and 7*b* ends. By performing the first adjustment, an inter-roll cross between the upper backup roll 3 and the upper work roll 1 is adjusted to within an allowable range.

(Second Adjustment: S112 to S118)

Next, in the second adjustment, as illustrated in FIG. 4, the rolling mill is adjusted so that a rolling direction force difference acting on the upper work roll 1 that is in the roll assembly on the opposite side to the lower backup roll 4 that is the reference roll becomes zero (P12). As shown in FIG. 3B, in a state in which the respective rolls are being rotated by the driving electric motor 21, the inter-roll cross control unit 23 measures rolling direction forces acting on the upper work roll 1 by means of the rolling direction force measurement apparatuses 24*a* to 24*d* (S112). Upon the rolling direction forces on the entrance side and the exit side of the upper work roll chocks 5*a* and 5*b* that are on the work side being measured by the rolling direction force measurement apparatuses 24*a* and 24*b*, the rolling direction force acting on the work side of the upper work roll 1 is calculated by the upper work roll work-side rolling direction force calculation apparatus 26. Further, upon the rolling direction forces on the entrance side and the exit side of the upper work roll chocks 5*a* and 5*b* that are on the drive side being measured by the rolling direction force measurement apparatuses 24*c* and 24*d*, the rolling direction force acting on the drive side of the upper work roll 1 is calculated by the upper work roll drive-side rolling direction force calculation apparatus (not illustrated in the drawings). Subsequently, a rolling direction force difference acting on the upper work roll 1 that is the difference between the rolling direction force on the work side and the rolling direction force on the drive side of the upper work roll 1 is calculated by the upper work roll work side-drive side difference calculation apparatus 28 (S114). The rolling direction force difference acting on the upper work roll 1 is output to the inter-roll cross control unit 23.

Next, the inter-roll cross control unit 23 controls the positions of the upper work roll chocks 5*a* and 5*b* so that the measured rolling direction force difference acting on the upper work roll 1 falls within an allowable range (S116). The inter-roll cross control unit 23 instructs the roll chock rolling direction force control unit 15 and the roll chock position control unit 16 so as to adjust the positions of the upper work roll chocks 5*a* and 5*b*. While detecting the positions of the upper work roll chocks 5*a* and 5*b* by means of the roll chock position control unit 16, the positions of the upper work roll chocks 5*a* and 5*b* are adjusted by the roll chock rolling direction force control unit 15 until the rolling direction force difference acting on the upper work roll 1 falls within the allowable range (S118). At this time, control of the positions of the upper backup roll chocks 7*a* and 7*b* is performed so that the upper backup roll 3 for which the inter-roll cross with respect to the upper work roll 1 was already adjusted also moves simultaneously with and in the same direction as the upper work roll 1 while maintaining the relative positions between the roll chocks with respect to the upper work roll 1. By this means, adjustment of an inter-roll cross between the upper backup roll 3, the upper work roll 1 and the lower work roll 2 can be performed.

Subsequently, in step S118, when it is determined that the rolling direction force difference acting on the upper work roll 1 is within the allowable range, position adjustment of the upper work roll chocks 5*a* and 5*b* ends. By performing the second adjustment, the inter-roll cross between the upper backup roll 3, the upper work roll 1 and the lower work roll 2 is adjusted to within an allowable range.

(Third Adjustment: S120 to S128)

Figure 3C:
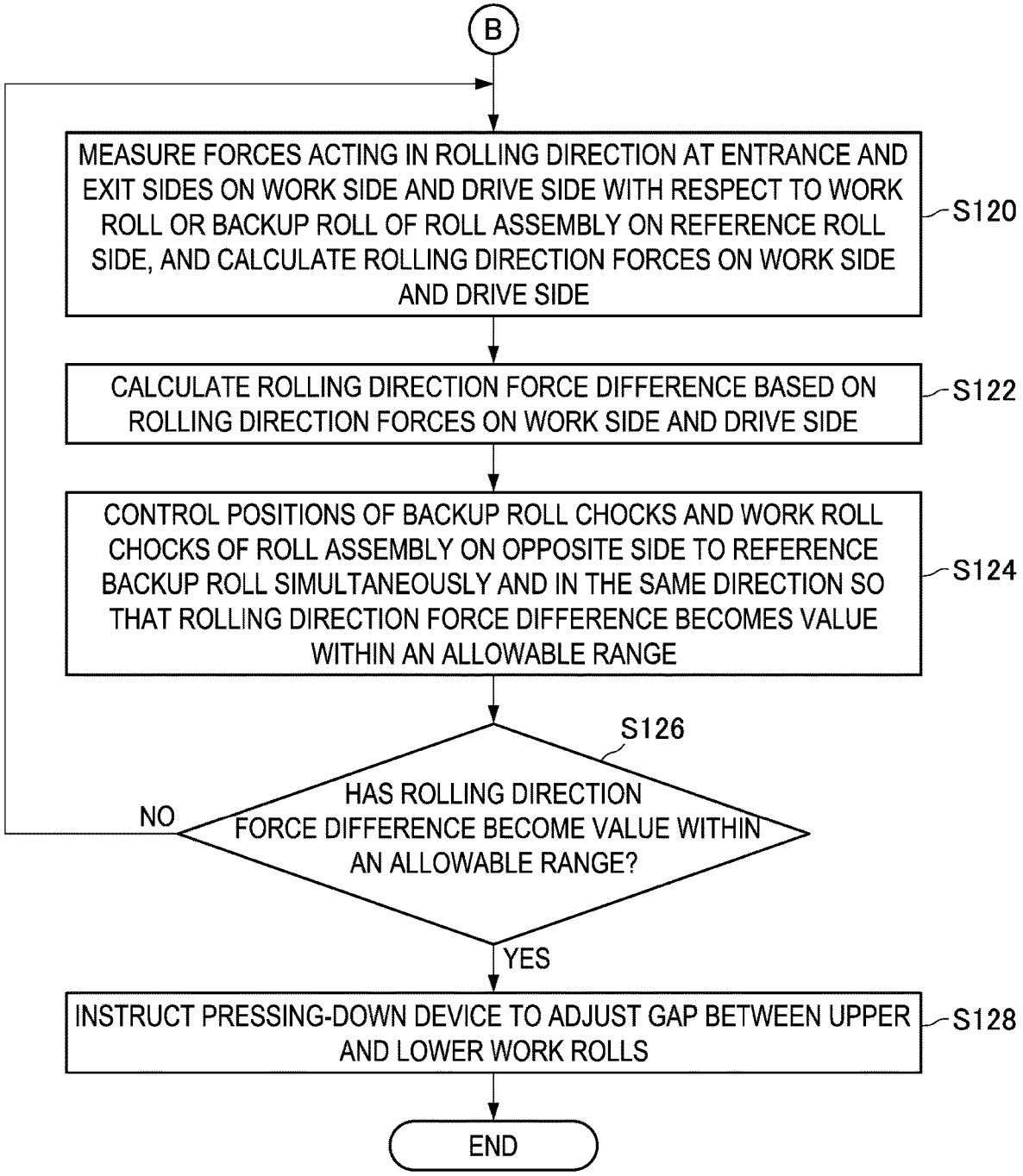
FIG. 3C is a flowchart describing a method for setting a rolling mill according to the first embodiment, which illustrates an example of a case of performing position adjustment from a roll on an opposite side to a reference roll.
Figure 4:
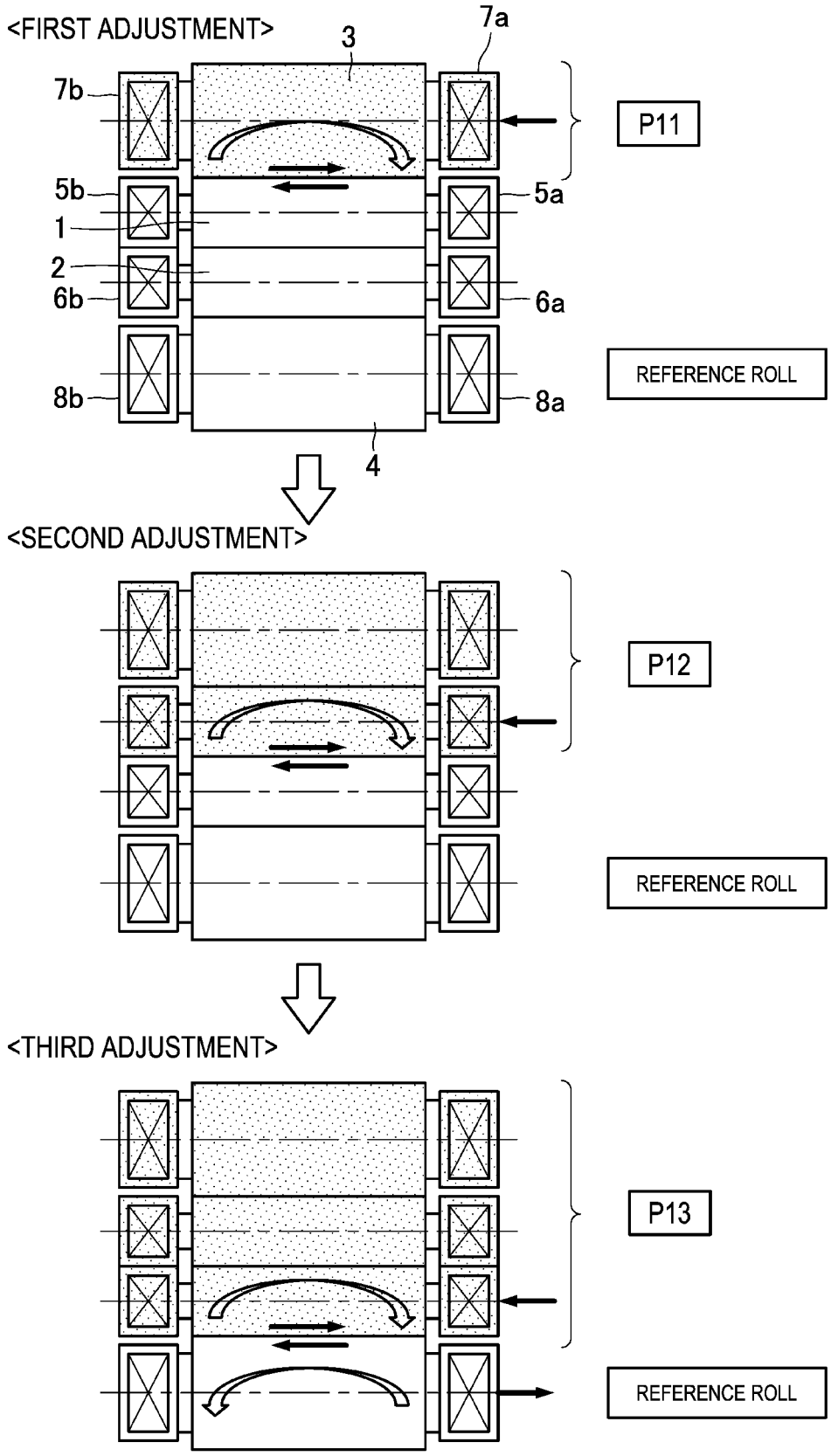
FIG. 4 is an explanatory drawing showing procedures for roll position adjustment in the method for setting a rolling mill illustrated in FIG. 3A to FIG. 3C.

Next, in the third adjustment, as illustrated in FIG. 3C and FIG. 4, roll chock positions are adjusted so that rolling direction force differences acting on the lower work roll 2 that is in the roll assembly on the same side as the lower backup roll 4 that is the reference roll, or the lower backup roll 4 becomes zero (P13). Because the inter-roll cross of the roll assembly on the upper side relative to the lower work roll 2 has already been adjusted, an inter-roll cross exists only between the lower work roll 2 and the lower backup roll 4, and thrust counterforces are generated due to the inter-roll cross. At such time, thrust counterforces of the same magnitude with different signs are generated between the lower work roll 2 and the lower backup roll 4. Therefore, the inter-roll cross can be made zero by adjusting the chock positions so that either of the rolling direction force differences is made zero.

In a state in which the respective rolls are being rotated by the driving electric motor 21, the inter-roll cross control unit 23 issues an instruction so as to measure rolling direction forces acting on the lower work roll 2 by means of the rolling direction force measurement apparatuses 25*a* to 25*d*, or to measure rolling direction forces acting on the lower backup roll 4 by means of the rolling direction force measurement apparatuses 35*a* to 35*d* (S120).

In a case where the rolling direction forces acting on the lower work roll 2 were measured by the rolling direction force measurement apparatuses 25*a* to 25*d*, rolling direction forces on the work side and on the drive side of the lower work roll 2 are calculated by the lower work roll work-side rolling direction force calculation apparatus 27 and the lower work roll drive-side rolling direction force calculation apparatus (not illustrated in the drawings), respectively. The difference between the rolling direction force acting on the work side and the rolling direction force acting on the drive side of the lower work roll 2 is then calculated by the lower work roll work side-drive side difference calculation apparatus 29. On the other hand, in a case where the rolling direction forces acting on the lower backup roll 4 were measured by the rolling direction force measurement apparatuses 35*a* to 35*d*, rolling direction forces on the work side and on the drive side of the lower backup roll 4 are calculated by the lower backup roll work-side rolling direction force calculation apparatus 37 and the lower backup roll drive-side rolling direction force calculation apparatus (not illustrated in the drawings), respectively. The difference between the rolling direction force acting on the work side and the rolling direction force acting on the drive side of the lower backup roll 4 is then calculated by the lower backup roll work side-drive side difference calculation apparatus 39 (S122).

The rolling direction force difference acting on the lower work roll 2 or the rolling direction force difference acting on the lower backup roll 4 calculated in this manner is output to the inter-roll cross control unit 23.

Next, the inter-roll cross control unit 23 controls the positions of the lower work roll chocks 6*a* and 6*b* so that the measured rolling direction force difference falls within an allowable range (S124). The inter-roll cross control unit 23 instructs the roll chock rolling direction force control unit 15 and the roll chock position control unit 16 so as to adjust the positions of the lower work roll chocks 6*a* and 6*b*. While detecting the positions of the lower work roll chocks 6*a* and 6*b* by means of the roll chock position control unit 16, the positions of the lower work roll chocks 6*a* and 6*b* are adjusted by the roll chock rolling direction force control unit 15 until the rolling direction force difference calculated in step S124 falls within the allowable range (S126). At this time, control of the positions of the upper work roll chocks 5*a* and 5*b* and the upper backup roll chocks 7*a* and 7*b* is performed so that the upper work roll 1 and the upper backup roll 3 for which an inter-roll cross with respect to the lower work roll 2 was already adjusted also move simultaneously with and in the same direction as the lower work roll 2 while maintaining the relative positions between the roll chocks. By this means, adjustment of an inter-roll cross between the upper backup roll 3, the upper work roll 1, the lower work roll 2 and the lower backup roll 4 can be performed.

Subsequently, in step S126, when it is determined that the rolling direction force difference calculated in step S122 is within the allowable range, position adjustment of the lower work roll chocks 6*a* and 6*b* ends. By performing the third adjustment, an inter-roll cross between the upper backup roll 3, the upper work roll 1, the lower work roll 2 and the lower backup roll 4 is adjusted to within an allowable range. When an inter-roll cross between all the rolls of the rolling mill has been made to fall within an allowable range in this manner, the inter-roll cross control unit 23 causes the pressing-down device 50 to adjust the roll gap between the upper work roll 1 and the lower work roll 2 so that the roll gap becomes a predetermined size (S128). Thereafter, rolling of a workpiece by the rolling mill is started.

A rolling mill and a method for setting a rolling mill according to the first embodiment of the present invention have been described above.

3. Second Embodiment

Next, a rolling mill according to a second embodiment of the present invention, the configuration of an apparatus for controlling the rolling mill, and a method for setting a rolling mill will be described based on FIG. 5 to FIG. 7. In the second embodiment, first, with respect to an upper roll assembly that is composed of the upper work roll 1 and the upper backup roll 3, and a lower roll assembly that is composed of the lower work roll 2 and the lower backup roll 4, operations are performed to make rolling direction force differences acting on the work rolls 1 and 2 zero, respectively.

Thereafter, the upper work roll 1 and the lower work roll 2 are set in a kiss roll state, and operations are performed to make rolling direction force differences acting on the upper work roll 1 and the lower work roll 2 zero. By this means, adjustment is performed to make inter-roll cross angles for all the rolls constituting the rolling mill zero, and thus rolling is realized in which thrust forces do not arise.

[3-1. Configuration of Rolling Mill]

First, the rolling mill according to the present embodiment and an apparatus for controlling the rolling mill will be described based on FIG. 5. FIG. 5 is an explanatory drawing illustrating the configuration of the rolling mill according to the present embodiment and an apparatus for controlling the rolling mill. The rolling mill illustrated in FIG. 5 is shown in a state as seen from the work side in the axial direction of the rolls, and in FIG. 5 a configuration in a case where the lower backup roll is adopted as the reference roll is illustrated. Note that, in the invention according to the present embodiment, it suffices to set any one roll among the respective rolls arranged in the vertical direction as the reference roll. The reference roll is preferably a roll for which the area of contact between the chocks and the housing is large, and which is located at the lowermost part or the uppermost part, where the position is stable.

Figure 5:
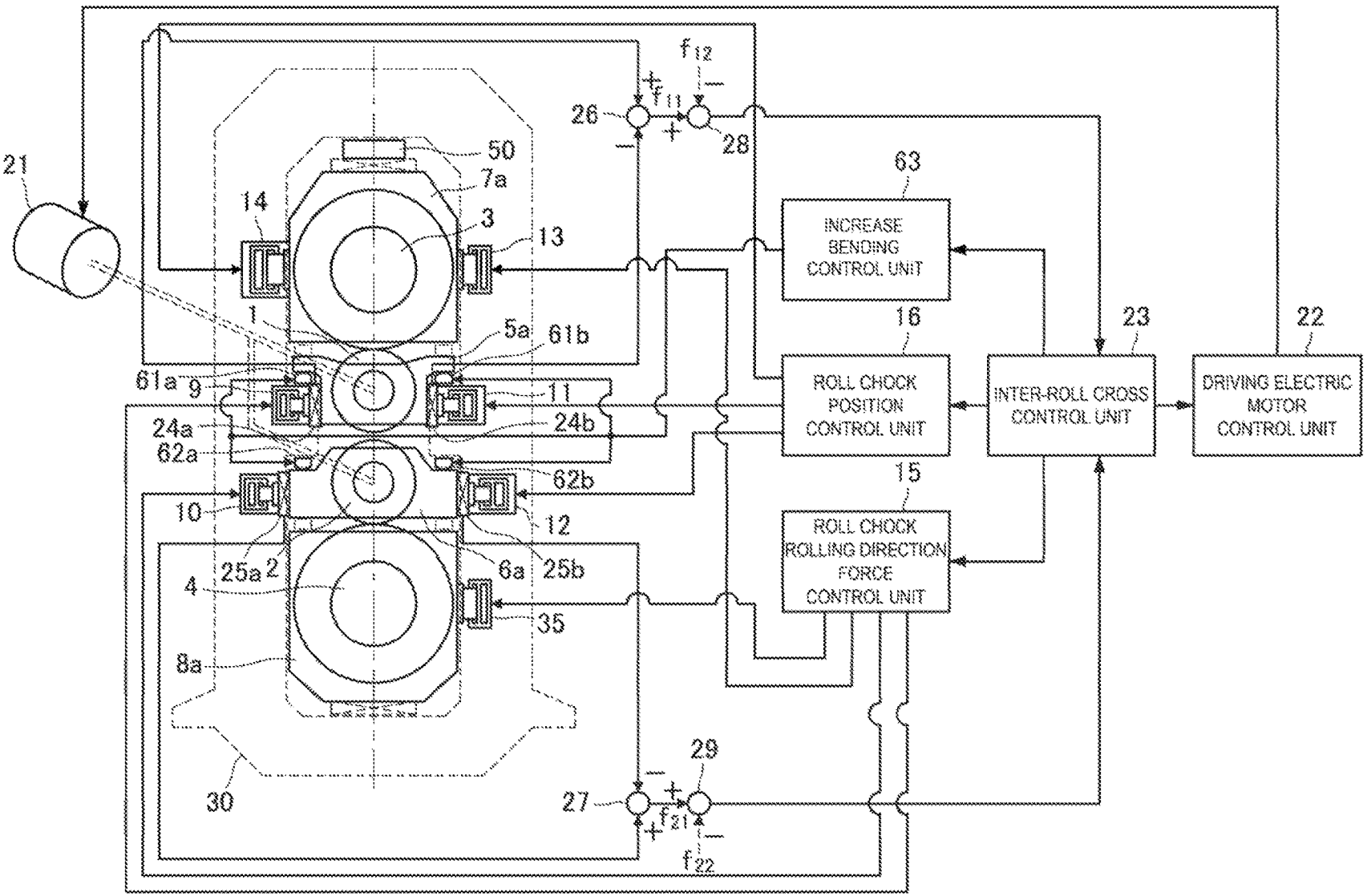
FIG. 5 is an explanatory drawing illustrating the configuration of a rolling mill according to a second embodiment of the present invention, and an apparatus for controlling the rolling mill.

The rolling mill according to the present embodiment that is illustrated in FIG. 5 is a four-high rolling mill having a pair of work rolls 1 and 2 and a pair of backup rolls 3 and 4 that support the pair of work rolls 1 and 2. The configuration of the rolling mill according to the present embodiment differs from the configuration of the rolling mill of the first embodiment illustrated in FIG. 2A in that the rolling direction force measurement apparatuses 34*a* to 34*d* of the upper backup roll chocks 7*a* and 7*b* and the rolling direction force measurement apparatuses 35*a* to 35*d* of the lower backup roll chocks 8*a* and 8*b* are not provided in the rolling mill of the present embodiment, and in that the rolling mill of the present embodiment includes increase bending apparatuses 61*a*, 61*b* and 62*a*, 62*b* and an increase bending control unit 63 that controls the increase bending apparatuses 61*a*, 61*b* and 62*a*, 62*b*. The remaining configuration is the same as the configuration of the rolling mill of the first embodiment illustrated in FIG. 2A, and therefore a description thereof is omitted in the present embodiment.

The rolling mill according to the present embodiment includes an entrance-side upper increase bending apparatus 61*a* and an exit-side upper increase bending apparatus 61*b* on a project block between the upper work roll chocks 5*a* and 5*b* and the housing 30, and includes an entrance-side lower increase bending apparatus 62*a* and an exit-side lower increase bending apparatus 62*b* on a project block between the lower work roll chocks 6*a* and 6*b* and the housing 30. Further, although not illustrated in the drawings, on the side facing away from the viewer (drive side) in FIG. 7, an entrance-side upper increase bending apparatus, an exit-side upper increase bending apparatus, an entrance-side lower increase bending apparatus and an exit-side lower increase bending apparatus for the drive side are similarly provided. The respective increase bending apparatuses impart an increase bending force to the work roll chocks to apply a load to the upper work roll 1 and the upper backup roll 3, and the lower work roll 2 and the lower backup roll 4.

The increase bending control unit 63 is an apparatus that controls each of the increase bending apparatus 61*a*, 61*b* and 62*a*, 62*b*. The increase bending control unit 63 according to the present embodiment controls the increase bending apparatuses so as to impart increase bending forces to the work roll chocks, based on an instruction from the inter-roll cross control unit 23. Note that, the increase bending control unit 63 may also be used in cases other than a case of performing adjustment of an inter-roll cross according to the present embodiment, for example, when performing crown control or shape control of a workpiece. Further, the entrance-side upper increase bending apparatuses 61*a*, the exit-side upper increase bending apparatuses 61*b*, the entrance-side lower increase bending apparatuses 62*a* and the exit-side lower increase bending apparatuses 62*b* are bending apparatuses that impart a bending force to rolls, and in some cases are also referred to simply as "bending apparatuses".

[3-2. Method for Setting Rolling Mill]

Figure 6A:
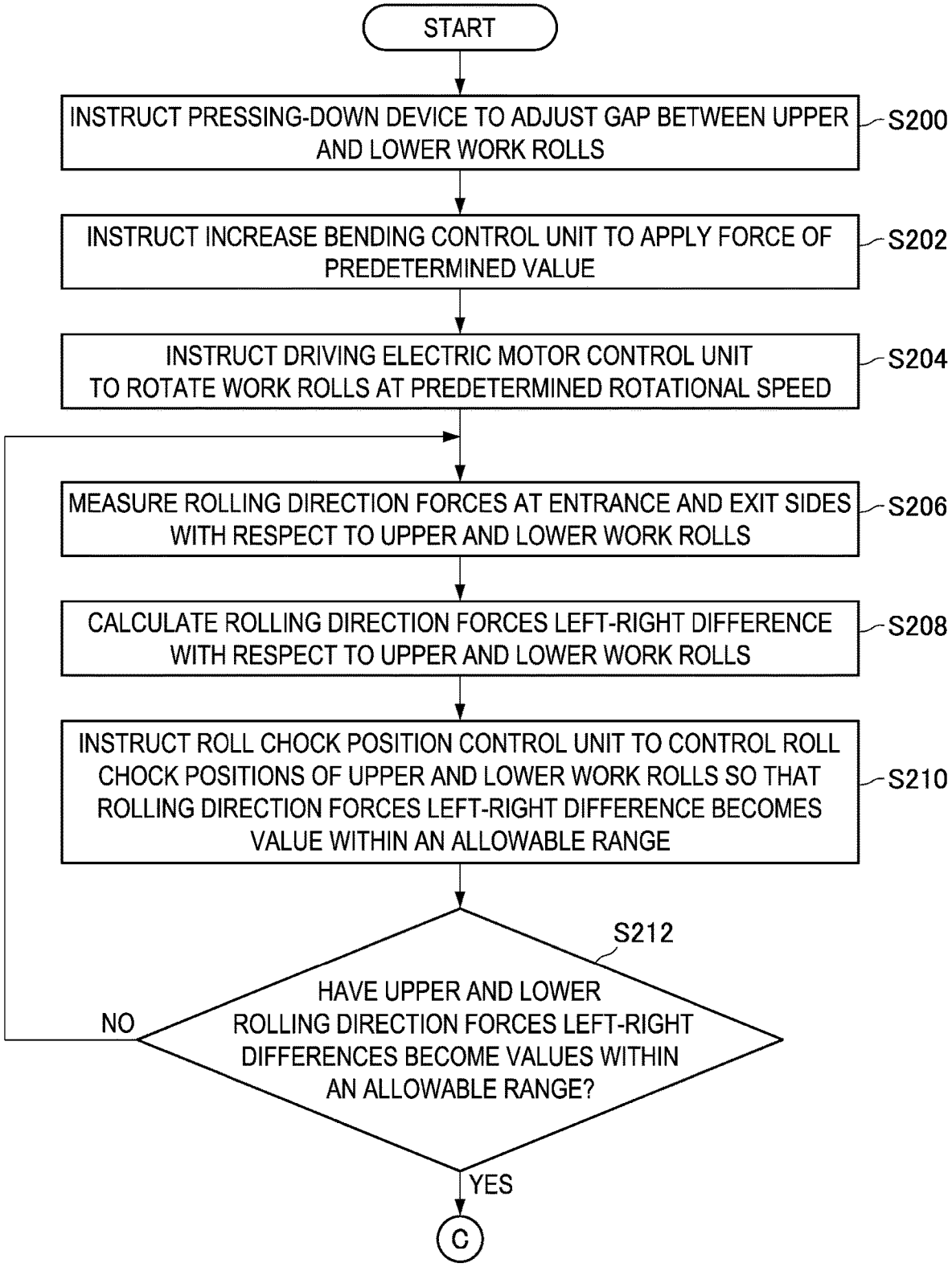
FIG. 6A is a flowchart describing the method for setting a rolling mill according to the second embodiment.
Figure 6B:
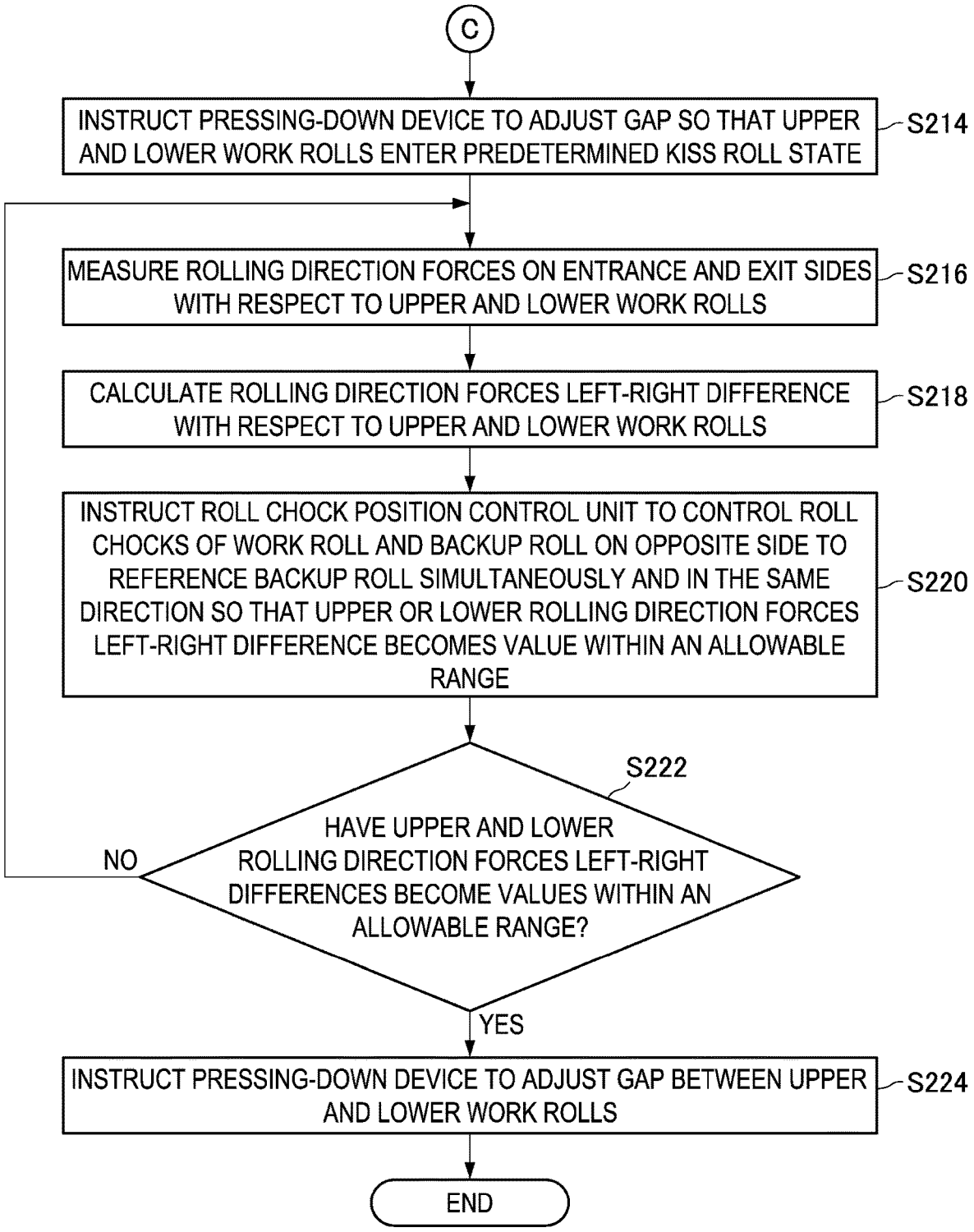
FIG. 6B is a flowchart describing the method for setting a rolling mill according to the second embodiment.

Next, the method for setting a rolling mill according to the present embodiment will be described based on FIG. 6A to FIG. 7. FIG. 6A and FIG. 6B are flowcharts illustrating the method for setting a rolling mill according to the present embodiment. FIG. 7 is an explanatory drawing showing procedures for roll position adjustment in the method for setting a rolling mill illustrated in FIG. 6A and FIG. 6B. Note that, in FIG. 7, a description of the distribution of loads acting between rolls is omitted, and a situation is described in which only inter-roll thrust forces that are the target appear as measurement values of the rolling direction forces.

In the method for setting a rolling mill according to the present embodiment, first, a roll gap between the upper work roll 1 and the lower work roll 2 is set in an open state, and then, with respect to the upper roll assembly and the lower roll assembly, operations are performed independently and respectively to adjust the positions of the work roll chocks that have an increase bending apparatus so that a rolling direction force acting on each work roll becomes zero, and an inter-roll cross between the rolls is made to fall within an allowable range. Next, the upper work roll 1 and the lower work roll 2 are set in a kiss roll state, and thereafter the positions of the roll chocks of either one of the roll assemblies are adjusted so that rolling direction forces acting on the upper work roll 1 and the lower work roll 2 become zero. By this means, an inter-roll cross between the upper roll assembly and the lower roll assembly falls within an allowable range, and an inter-roll cross between all the rolls constituting the rolling mill is made to fall within an allowable range. Thus, in the present embodiment also, the rolling direction position of the roll chocks of the reference roll is fixed as a reference position, and the positions in the rolling direction of the roll chocks of rolls other than the reference roll are moved to thereby adjust the positions of the roll chocks. These operations are described in detail hereunder.

(Adjustment of Inter-Roll Cross of Each Roll Assembly (First Adjustment): S200 to S212)

In a first adjustment in which position adjustment is performed in a state in which the roll gap is open, the upper work roll and the lower work roll are set in an open state, increase bending forces are imparted to apply loads between the work rolls and backup rolls, and the positions of the upper and lower work roll chocks are controlled so that a left-right difference between rolling direction forces that arises due to changes in the load distribution between the rolls that occur due to thrust forces between the relevant rolls in that state becomes a predetermined target value. First, as illustrated in FIG. 6A, the inter-roll cross control unit 23 causes the pressing-down device 50 to adjust the roll positions in the vertical direction so that the roll gap between the upper work roll 1 and the lower work roll 2 becomes an open state having a predetermined gap (S200). Based on the relevant instruction, the pressing-down device 50 sets the increase bending forces in a balanced state, and sets the roll gap between the work rolls 1 and 2 in an open state. Note that, as used herein, the term "balanced state" refers to a state in which a bending force of a degree that lifts up the self-weight of the work roll, roll chocks or the like is applied, and means that a load acting between the work roll and the backup roll is approximately zero.

Further, the inter-roll cross control unit 23 instructs the increase bending control unit 63 so as to apply a predetermined increase bending force from the balanced state to the work roll chocks 5 and 6 by means of the increase bending apparatuses 61*a*, 61*b* and 62*a*, 62*b* (S202). The increase bending control unit 63 controls the respective increase bending apparatuses 61*a*, 61*b* and 62*a*, 62*b* based on the instruction, to thereby apply a predetermined increase bending force to the work roll chocks 5 and 6. By this means, a predetermined load can be applied only between the work roll and backup roll on the upper side and lower side, respectively, without causing a load to act between the upper and lower work rolls. Note that, either step among step S200 and step S202 may be executed first.

Next, the inter-roll cross control unit 23 drives the driving electric motor 21 by means of the driving electric motor control unit 22 to cause the upper and lower work rolls 1 and 2 to rotate (S204). Subsequently, the rolling direction forces acting on the upper and lower work rolls are measured (S206), and a rolling direction force difference is calculated (S208).

With respect to the rolling direction forces acting on the upper work roll 1, first, based on rolling direction forces measured by the rolling direction force measurement apparatuses 24*a* to 24*d*, the rolling direction forces on the work side and the drive side of the upper work roll 1 are calculated by the upper work roll work-side rolling direction force calculation apparatus 26 and the upper work roll drive-side rolling direction force calculation apparatus (not illustrated in the drawings), respectively. Next, the difference between the rolling direction force acting on the work side and the rolling direction force acting on the drive side of the upper work roll 1 is calculated by the upper work roll work side-drive side difference calculation apparatus 28, to thereby calculate a rolling direction force difference acting on the upper work roll 1.

On the other hand, with respect to the rolling direction forces acting on the lower work roll 2, first, based on rolling direction forces measured by the rolling direction force measurement apparatuses 25*a* to 25*d*, the rolling direction forces on the work side and the drive side of the lower work roll 2 are calculated by the lower work roll work-side rolling direction force calculation apparatus 27 and the lower work roll drive-side rolling direction force calculation apparatus (not illustrated in the drawings), respectively. Next, the difference between the rolling direction force acting on the work side and the rolling direction force acting on the drive side of the lower work roll 2 is calculated by the lower work roll work side-drive side difference calculation apparatus 29, to thereby calculate a rolling direction force difference acting on the lower work roll 2.

The rolling direction force differences acting on the upper and lower work rolls that are calculated are output to the inter-roll cross control unit 23. The inter-roll cross control unit 23 then controls the positions of the roll chocks of the rolls that have a bending apparatus, that is, the work roll chocks 5 and 6, so that the rolling direction force differences acting on the upper and lower work rolls become values that are within an allowable range (first adjustment in FIG. 7 (P21, P22), S210). While the roll chock rolling direction force control unit 15 imparts a predetermined pressing force in the rolling direction, and the positions of the work roll chocks 5 and 6 are being detected by the roll chock position control unit 16, the positions of the work roll chocks 5 and 6 are adjusted until the rolling direction force differences acting on the work rolls fall within an allowable range (S212). Note that, whilst a case has been described above in which the upper work roll chocks 5*a* and 5*b* are subjected to position control as the first adjustment (P21 and P22 in FIG. 7), it is also possible to execute the first adjustment by another method. For example, with respect to the upper roll assembly, the first adjustment may be performed by performing position control of the backup roll of the roll assembly on the opposite side to the reference roll, that is, position control of the upper backup roll chocks 7*a* and 7*b* (P23 in FIG. 7), so that a rolling direction force difference acting on the upper work roll of the upper roll assembly becomes a value within an allowable range. At such time, with respect to the lower roll assembly, the positions of the lower work roll chocks 6 are adjusted (P24) in a similar manner to P22 in FIG. 7.

Subsequently, in step S212, with respect to the upper roll assembly and the lower roll assembly, when it is determined that rolling direction force differences acting on the work rolls or backup rolls are within an allowable range, position adjustment of the work roll chocks 5 and 6 ends. By means of the first adjustment performed in this manner, an inter-roll cross between the upper backup roll 3 and the upper work roll 1, and an inter-roll cross between the lower backup roll 4 and the lower work roll 2 are each adjusted to within an allowable range. Note that, whilst an example has been described here in which operations to adjust inter-roll crosses of the upper roll assembly and the lower roll assembly are executed concurrently, the present invention is not limited to this example, and operations may be performed in a manner such that the inter-roll cross of one of the roll assemblies is adjusted first, and thereafter the inter-roll cross of the other roll assembly is adjusted. Further, at the stage at which the processing up to step S212 has ended, driving of the driving electric motor 21 may be temporarily stopped, or the operations may proceed to the next step while maintaining the state in which rotation of the rolls is continuing.

(Adjustment of Inter-Roll Cross Between Upper Roll Assembly and Lower Roll Assembly (Second Adjustment): S214 to S224)

Figure 7:
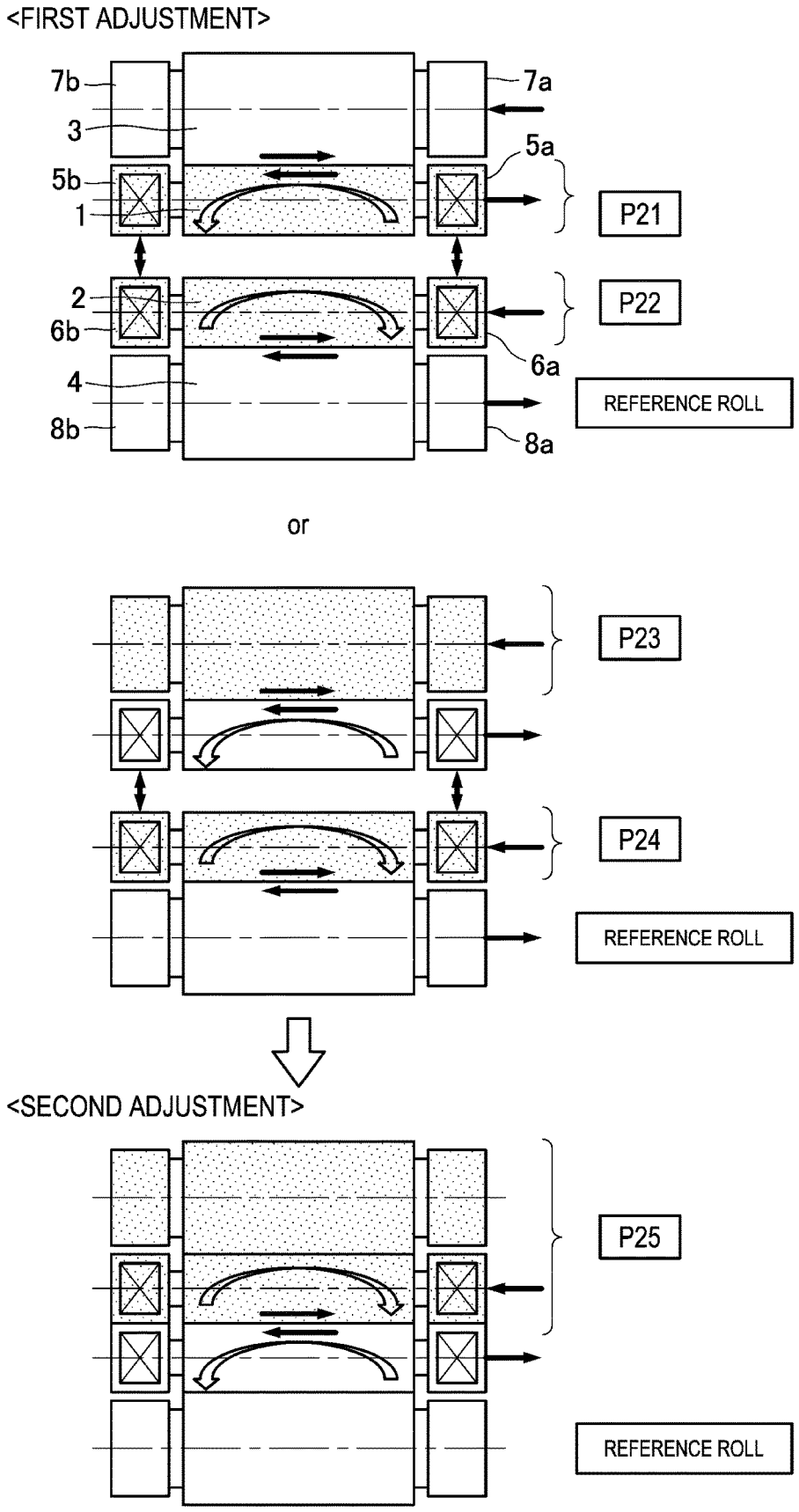
FIG. 7 is an explanatory drawing showing procedures for roll position adjustment in the method for setting a rolling mill illustrated in FIG. 6A and FIG. 6B.

In each of the upper roll assembly and the lower roll assembly, when an inter-roll cross between the work roll and the backup roll has been adjusted, next, as a second adjustment, the inter-roll cross control unit 23 adjusts an inter-roll cross between the upper roll assembly and the lower roll assembly, as illustrated on the lower side in FIG. 7. As shown in FIG. 6B, first, the inter-roll cross control unit 23 causes the pressing-down device 50 to adjust roll positions in the vertical direction so that the upper work roll 1 and the lower work roll 2 enter a predetermined kiss roll state (S214). The pressing-down device 50 applies a predetermined load to the rolls based on the instruction to thereby cause the work rolls 1 and 2 to come in contact and enter a kiss roll state.

Next, the inter-roll cross control unit 23 causes the driving electric motor 21 to drive by means of the driving electric motor control unit 22 to cause each roll to rotate, and rolling direction force differences acting on the upper work roll 1 and the lower work roll 2 are determined by measuring rolling direction forces by means of the rolling direction force measurement apparatuses 24*a* to 24*d* and 25*a* to 25*d* (S216), and calculating the rolling direction force differences based on the measured rolling direction forces (S218). It suffices to perform the processing in steps S216 and S218 in a similar manner to the processing in steps S206 and S208, and hence a description of the processing in steps S216 and S218 is omitted here. The calculated rolling direction force differences are output to the inter-roll cross control unit 23.

Next, the inter-roll cross control unit 23 controls the positions of the work roll chocks and the backup roll chocks of the upper roll assembly or the lower roll assembly simultaneously and in the same direction while maintaining the relative position between the roll chocks, so that rolling direction force differences acting on the upper work roll 1 and the lower work roll 2 become a value within an allowable range (S220). For example, when it is assumed that the lower roll assembly is adopted as a reference roll assembly, the positions of the upper work roll chocks 5*a* and 5*b* and the upper backup roll chocks 7*a* and 7*b* of the upper roll assembly are controlled so that an inter-roll cross with respect to the lower roll assembly falls within an allowable range (P25 in FIG. 7).

The inter-roll cross control unit 23 instructs the roll chock rolling direction force control unit 15 and the roll chock position control unit 16 so as to adjust the positions of the work roll chocks and the backup roll chocks on the opposite side to the reference roll assembly. While detecting the positions of the work roll chocks and the backup roll chocks by means of the roll chock position control unit 16, the roll chock rolling direction force control unit 15 adjusts the positions of the work roll chocks and the backup roll chocks until rolling direction force differences acting on the upper work roll 1 and the lower work roll 2 fall within the allowable range (S222). At this time, the inter-roll cross of the upper roll assembly and the inter-roll cross of the lower roll assembly have already been adjusted. Therefore, position control of not only the work roll chocks but also the backup roll chocks is performed so that the backup rolls move simultaneously with and in the same direction as the work rolls while maintaining the relative positions between the roll chocks.

Subsequently, in step S222, when it is determined that the rolling direction force differences acting on the upper work roll 1 and the lower work roll 2 have entered the allowable range, the inter-roll cross between the upper backup roll 3, the upper work roll 1, the lower work roll 2 and the lower backup roll 4 is adjusted to within an allowable range. When the inter-roll cross with respect to all of the rolls of the rolling mill falls within the allowable range in this manner, the inter-roll cross control unit 23 causes the pressing-down device 50 to perform adjustment so that the roll gap between the upper work roll 1 and the lower work roll 2 becomes a predetermined size (S224). Thereafter, rolling of a workpiece by the rolling mill is started.

A rolling mill and a method for setting a rolling mill according to the second embodiment of the present invention have been described above. Note that, whilst an example in which only the upper and lower work rolls are provided with rolling direction force measurement apparatuses is described above, the present invention is not limited to this example. For example, it need scarcely be said that control can be similarly performed in a case where, in addition to providing the rolling direction force measurement apparatuses for the upper and lower work rolls, rolling direction force measurement apparatuses are provided for at least one of the upper backup roll and the lower backup roll also.

4. Relation Between Inter-Roll Cross Angle and Various Values

In the methods for setting a rolling mill according to the first and second embodiments that are described above, position control of roll chocks is performed so that rolling direction force differences become zero or become a value within an allowable range in order to eliminate an inter-roll cross. This is based on the finding that the correlation described hereunder exists between rolling direction force differences and an inter-roll cross angle. Hereunder, based on FIG. 8 to FIG. 14, the relation between an inter-roll cross angle and various values will be described based on the results of experiments performed using a small rolling mill with a work roll diameter of 80 mm.

[4-1. Relation in Kiss Roll State (without a Pair Cross)]

Figure 8:
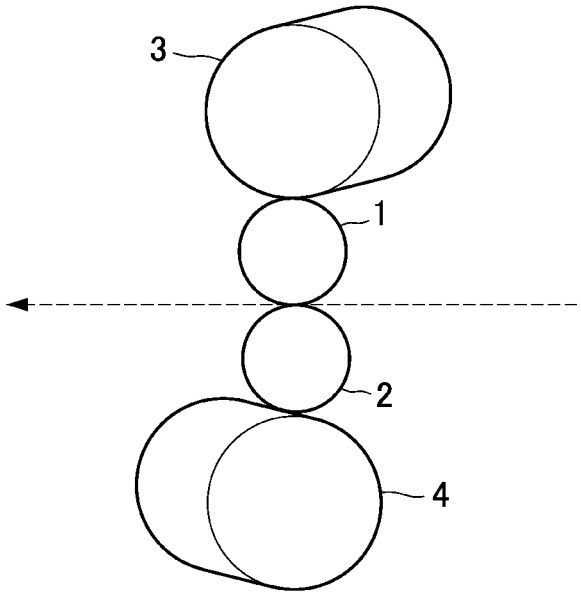
FIG. 8 is an explanatory drawing illustrating the arrangement of work rolls and backup rolls of a rolling mill set in a kiss roll state, that shows a state without a pair cross.
Figure 9:
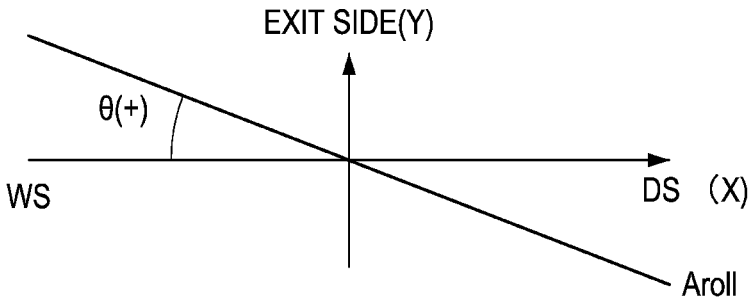
FIG. 9 is an explanatory drawing showing the definition of an inter-roll cross angle.
Figure 10:
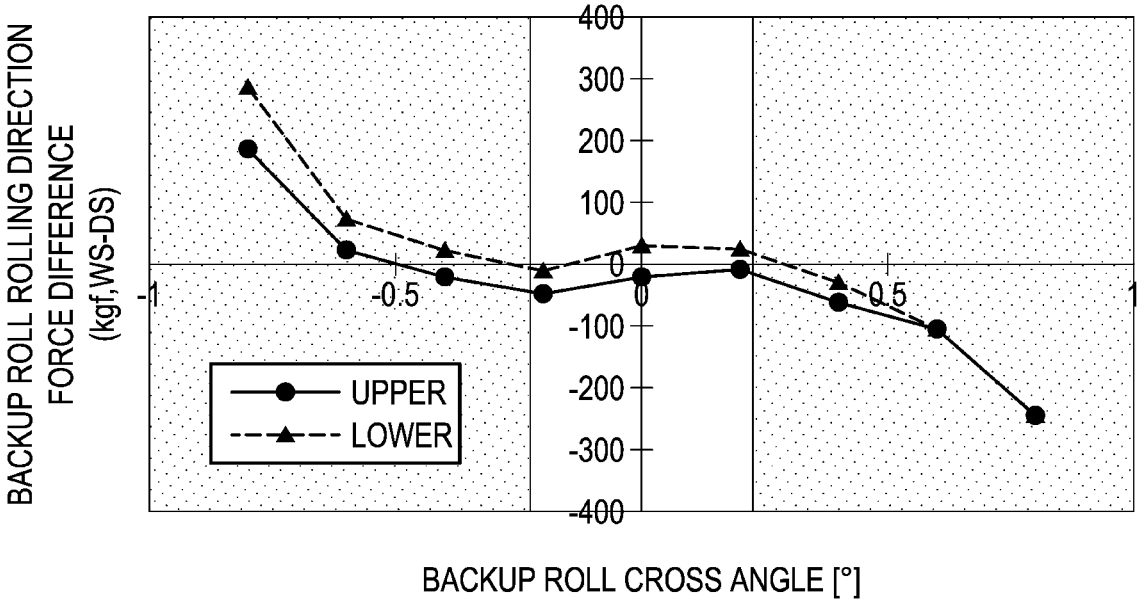
FIG. 10 is a graph showing a relation between a backup roll cross angle and a backup-roll rolling direction force in the kiss roll state illustrated in FIG. 9.

Next, based on FIG. 8 to FIG. 10, the relation between an inter-roll cross and various values in a case where the work rolls are in a kiss roll state will be described. FIG. 8 is an explanatory drawing illustrating the arrangement of the work rolls 1 and 2 and the backup rolls 3 and 4 of the rolling mill that has been set in a kiss roll state. FIG. 9 is an explanatory drawing showing the definition of an inter-roll cross angle. FIG. 10 is a graph showing a relation between a backup roll cross angle and backup-roll rolling direction force differences in a kiss roll state. Note that, in FIG. 10, with respect to the backup-roll rolling direction force differences, values are shown that were obtained by measuring the backup-roll rolling direction force differences in both a case where a backup roll cross angle was set in an increasing direction and a case where a backup roll cross angle was set in a decreasing direction, respectively, and averaging the measurement values for the increasing direction and the measurement values for the decreasing direction. As illustrated in FIG. 9, with respect to the cross angle of a backup roll, a direction in which the work side of a roll axis $A_{roll}$ extending in the axial direction of the roll extends from the width direction (X-direction) toward the exit side is represented as positive.

In this case, as illustrated in FIG. 8, changes in the backup-roll rolling direction force difference when the upper work roll 1 and the lower work roll 2 were set in a kiss roll state and the cross angles of the upper backup roll 3 and the lower backup roll 4 were changed, respectively, were investigated. At such time, a kiss roll tightening load was made 0.5 tonf. As illustrated in FIG. 9, with respect to the cross angle of a backup roll, a direction in which the work side of a roll axis $A_{roll}$ extending in the axial direction of the roll extends from the width direction (X-direction) toward the exit side is represented as positive.

As a result it was found that, as illustrated in FIG. 10, there is a relation such that, as the cross angle of the upper backup roll 3 and the lower backup roll 4 gradually increases from a negative angle to an angle of zero to a positive angle, the value for the backup-roll rolling direction force difference increases in a similar manner to the cross angle when the cross angle is within the range of −0.2° to 0.2°. Further, with respect to the backup-roll rolling direction force differences, it was ascertained that these values also approach zero when the cross angle of the relevant backup roll is zero. Note that, in general, a minute cross angle is ±0.1° or less, and with respect to adjustment of the cross angle, it is sufficient to confirm the behavior of the rolling direction force difference in that range.

It is considered that the reason that a rolling direction force difference changes together with the cross angle is that the load distribution between rolls changes so that moments generated by inter-roll thrust forces enter a balanced state, and a left-right difference arises in a tangential force between rolls due to a left-right difference in the load distribution between rolls. Therefore, by controlling the positions of the roll chocks so that the rolling direction force difference becomes zero, the inter-roll load distribution can be made uniform and inter-roll thrust forces can be suppressed.

Therefore, in a tightened state in the kiss roll state, it is possible to ascertain the influence of thrust forces attributable to an inter-roll cross angle between a backup roll and a work roll of each roll assembly based on the values of backup-roll rolling direction force differences. Further, it is known that it is possible to reduce inter-roll thrust forces by controlling the positions of roll chocks so that these values become zero.

[4-2. Relation in Kiss Roll State (with a Pair Cross)]

Figure 11:
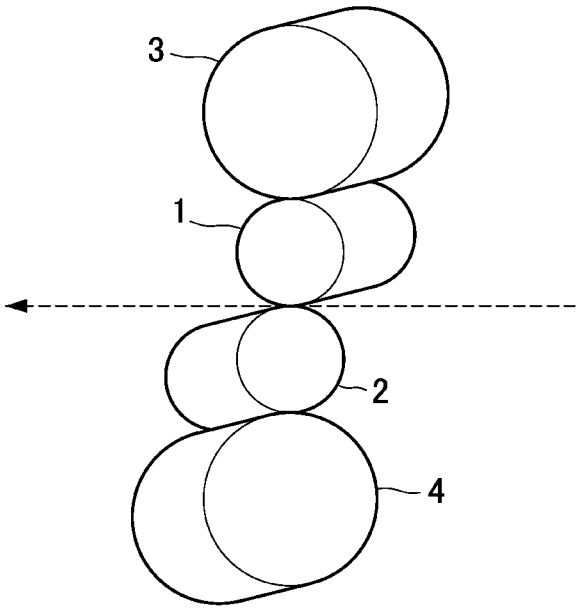
FIG. 11 is an explanatory drawing illustrating the arrangement of work rolls and backup rolls of a rolling mill set in a kiss roll state, that shows a state with a pair cross.
Figure 12A:
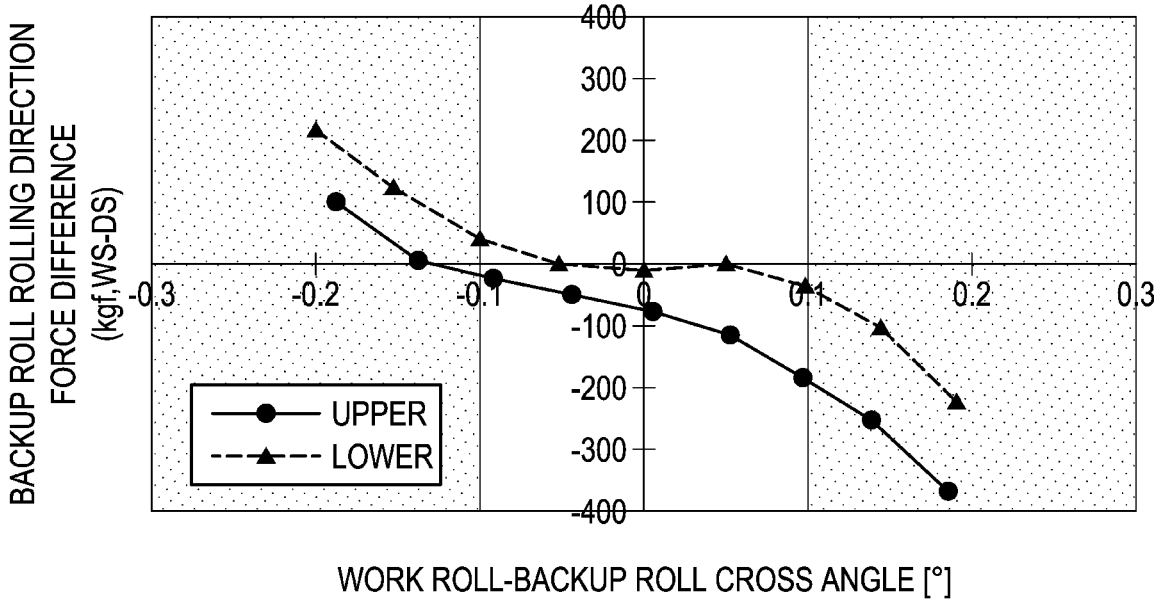
FIG. 12A is a graph illustrating a relation between a pair cross angle between a work roll and a backup roll, and upper and lower backup-roll rolling direction force differences in the kiss roll state illustrated in FIG. 11.
Figure 12B:
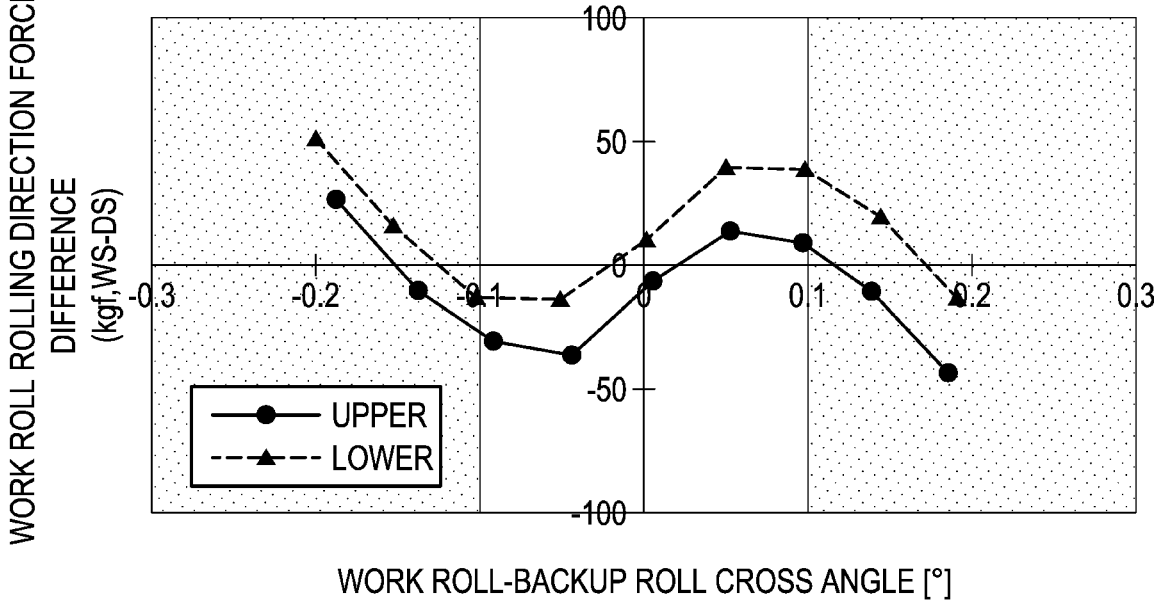
FIG. 12B is a graph illustrating a relation between a pair cross angle between a work roll and a backup roll, and upper and lower work-roll rolling direction force differences in the kiss roll state illustrated in FIG. 11.

Next, the relation between an inter-roll cross and various values in a case where the work rolls are in a kiss roll state will be described based on FIG. 11 to FIG. 12B. FIG. 11 is an explanatory drawing illustrating the arrangement of the work rolls 1 and 2 and the backup rolls 3 and 4 of a rolling mill that has been set in a kiss roll state. FIG. 12A is a graph illustrating a relation between a pair cross angle between a work roll and a backup roll, and upper and lower backup-roll rolling direction force differences in the kiss roll state. FIG. 12B is a graph illustrating a relation between a pair cross angle between a work roll and a backup roll, and upper and lower work-roll rolling direction force differences in the kiss roll state. Note that, in FIG. 12A and FIG. 12B, values are shown that were obtained by measuring upper and lower backup-roll rolling direction force differences and upper and lower work-roll rolling direction force differences in both a case where a pair cross angle was set in an increasing direction and a case where a pair cross angle was set in a decreasing direction, respectively, and averaging the measurement values for the increasing direction and the measurement values for the decreasing direction.

In this case, as illustrated in FIG. 11, changes in the work-roll rolling direction force difference and the backup-roll rolling direction force difference when the upper work roll 1 and the lower work roll 2 were set in a kiss roll state and pair cross angles between the work rolls and the backup rolls were changed, respectively, were investigated. At such time, a kiss roll tightening load was made 3.0 tonf per side.

As a result it was found that, as illustrated in FIG. 12A and FIG. 12B, as the pair cross angle gradually increases from a negative angle to an angle of zero to a positive angle, the rolling direction force differences of the backup roll and the work roll change together with changes in the cross angle between the work roll and the backup roll, and when the pair cross angle is zero, these measurement values also become approximately zero. By this means, in a state in which a kiss roll tightening load is applied, it is possible to detect the influence of thrust forces attributable to a cross between upper and lower work rolls based on the work-roll rolling direction force differences. Further, it was confirmed that there is a possibility that inter-roll thrust forces between upper and lower work rolls can be reduced by controlling roll chock positions in a manner that takes work rolls and backup rolls on the top and bottom, respectively, as a single body so that the aforementioned values become zero.

Note that, with respect to rolling direction force differences of the work rolls, although behavior is seen for a case where an extreme value is taken and is increased and decreased, when the cross angle is 0° the rolling direction force differences are approximately zero. The object of the roll chock position control is ±0.1° or less, and by controlling the positions of the roll chocks so that a rolling direction force difference in that range becomes zero, the load distribution between rolls can be made uniform and inter-roll thrust forces can be suppressed.

[4-3. Relation when Roll Gap is in Open State]

Figure 13:
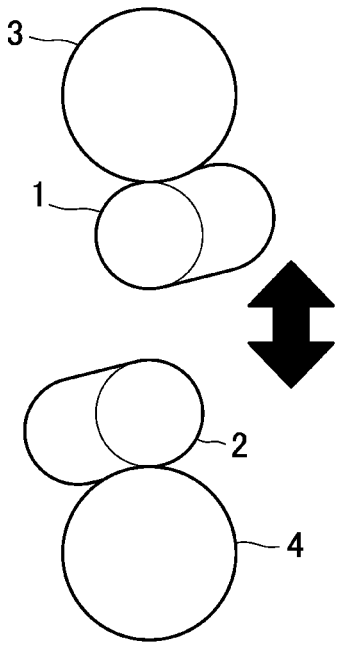
FIG. 13 is an explanatory drawing illustrating the arrangement of work rolls and backup rolls of a rolling mill in which a roll gap is in an open state.
Figure 14:
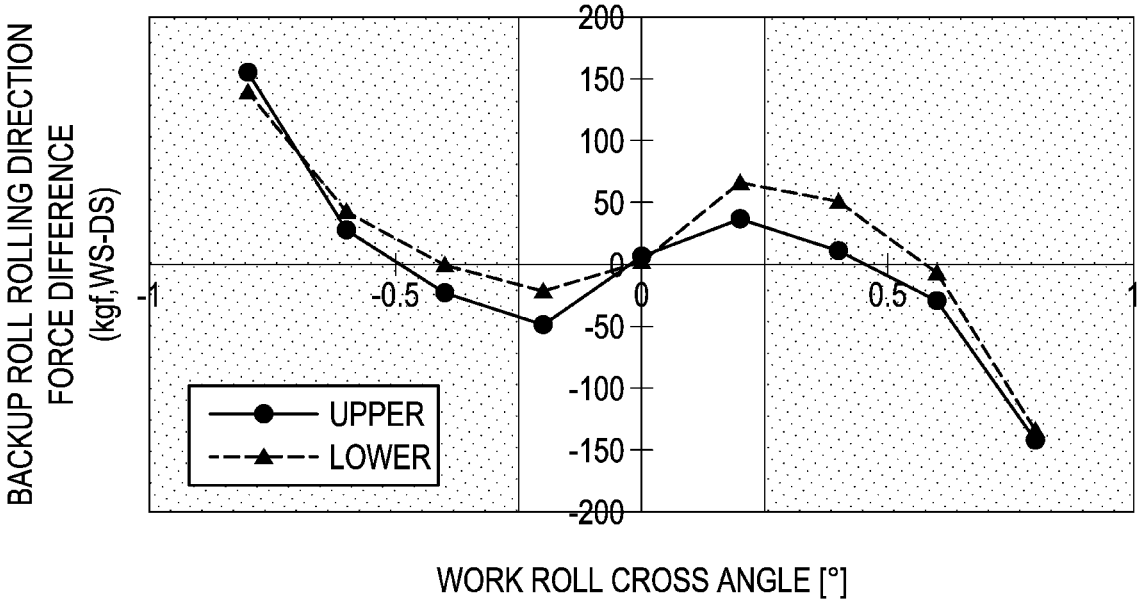
FIG. 14 is a graph illustrating a relation between a work roll cross angle and a backup-roll rolling direction force, in a state in which a roll gap is open.

The relation between an inter-roll cross and various values in a case where the roll gap between the work rolls is in an open state will now be described based on FIG. 13 to FIG. 14. FIG. 13 is an explanatory drawing illustrating the arrangement of the work rolls 1 and 2 and the backup rolls 3 and 4 of a rolling mill in which the roll gap is in an open state. FIG. 14 is a graph illustrating one relation between a work roll cross angle and upper and lower work-roll rolling direction force differences in a state in which the roll gap is open. Note that, in FIG. 14, values are shown that were obtained by measuring upper and lower work-roll rolling direction force differences in both a case where a work roll cross angle was set in an increasing direction and a case where a work roll cross angle was set in a decreasing direction, respectively, and averaging the measurement values for the increasing direction and the measurement values for the decreasing direction.

As illustrated in FIG. 13, the roll gap between the upper work roll 1 and the lower work roll 2 was set in an open state, and a state was formed in which an increase bending force was applied by increase bending apparatuses to the work roll chocks. Then, changes in the work-roll rolling direction force differences when the cross angles of the upper work roll 1 and the lower work roll 2 were changed, respectively, were investigated. The increase bending force was set to 0.5 tonf per roll chock.

As a result it was found that, as illustrated in FIG. 14, there is a relation such that, as the cross angle of the upper work roll 1 and the lower work roll 2 gradually increases from a negative angle to an angle of zero to a positive angle, the value for the work-roll rolling direction force difference gradually increases when the cross angle is within the range of −0.2° to 0.2°. Further, with respect to the work-roll rolling direction force differences, it was ascertained that these values also become zero when the cross angle of the work roll is zero.

Therefore, in a state in which the roll gap is in an open state and an increase bending force is applied, it is possible to ascertain the influence of thrust forces attributable to an inter-roll cross angle between a backup roll and a work roll of each roll assembly based on the values of work-roll rolling direction force differences. Further, it is known that it is possible to reduce inter-roll thrust forces by controlling the positions of roll chocks so that these values become zero.

EXAMPLE 1

A conventional method and the method of the present invention were compared with respect to fifth to seventh stands of a hot finish rolling mill having the configuration illustrated in FIG. 2A, in relation to reduction leveling setting that takes into consideration the influence of inter-roll thrust forces generated due to an inter-roll cross.

First, in the conventional method, without using the functions of the inter-roll cross control unit of the present invention, replacement of housing liners and chock liners was periodically performed, and equipment management was conducted so that an inter-roll cross would not occur. As a result, in a period immediately before replacement of the housing liner, when a thin and wide material having an exit side plate thickness of 1.2 mm and a width of 1200 mm was rolled, zigzagging of 100 mm or more occurred at the sixth stand, and tail crash occurred as a result.

On the other hand, in the method of the present invention, using the functions of the inter-roll cross control unit according to the first embodiment that is described above, in a kiss roll tightened state, rolling direction forces of the respective rolls were measured, and in accordance with the processing flow illustrated in FIG. 3A to FIG. 3C, the roll chock positions of the respective rolls were controlled so that the rolling direction force differences prior to rolling fell within an allowable range that was set in advance. As a result, in a period immediately before replacement of the housing liner also, even in a case where a thin and wide material having an exit side plate thickness of 1.2 mm and a width of 1200 mm with respect to which tail crash occurred in the conventional method was rolled, the occurrence of zigzagging stayed at 12 mm or less, and the workpiece could be passed through the rolling line without causing tail crash to occur in the workpiece.

As described above, according to the method of the present invention, rolling direction force differences of the respective rolls are measured before rolling, and the roll chock positions of the respective rolls are controlled with respect to a reference roll so that the rolling direction force differences enter an allowable range based on appropriate logic, and by this means an inter-roll cross itself is eliminated, and left-right asymmetric deformation of a workpiece that occurs due to thrust forces caused by an inter-roll cross can be eliminated. Therefore, a metal plate material can be stably produced without zigzagging and camber or with extremely little zigzagging and camber.

EXAMPLE 2

Next, a conventional method and the method of the present invention were compared with respect to a hot rolled thick-gauge plate rolling mill having the configuration illustrated in FIG. 5, in relation to reduction leveling setting that takes into consideration the influence of thrust forces generated due to an inter-roll cross.

First, in the conventional method, without using the functions of the inter-roll cross control unit of the present invention, replacement of housing liners and chock liners was periodically performed, and equipment management was conducted so that an inter-roll cross would not occur.

On the other hand, in the method of the present invention, using the functions of the inter-roll cross control unit according to the second embodiment that is described above, adjustment of the positions of roll chocks was performed in accordance with the processing flow illustrated in FIG. 6A and FIG. 6B before rolling. That is, first, in a state in which the roll gap was set in an open state and an increase bending force was applied, rolling direction forces acting on the upper and lower work rolls were measured and the positions of the upper and lower work roll chocks were controlled. Next, the upper and lower work rolls were set in a kiss roll state, rolling direction force differences acting on the upper and lower work rolls were calculated, and the positions of the roll chocks of the upper and lower work rolls and backup rolls were controlled so that the rolling direction force differences in question fell within an allowable range that was set in advance.

Table 1 shows actual measurement values for the occurrence of camber with regard to a representative number of rolled workpieces, with respect to the present invention and the conventional method. Among the actual measurement values for camber per 1 m of a front end position of the workpieces, when the value for a time that is immediately before backup roll replacement and also immediately before housing liner replacement is seen, it is found that in the case of the present invention the value is kept to a relatively small value of 0.12 mm/m. In contrast, in the case of the conventional method, in a period immediately before backup roll replacement and immediately before housing liner replacement, the actual measurement value for camber is large in comparison to the case of the present invention.

TABLE 1

| | Actual Measurement Values for Camber per 1 m at Front End Portion (mm/m) | | |
|---|---|---|---|
| | Immediately After Backup Roll Replacement | Immediately Before Backup Roll Replacement | Immediately Before Backup Roll Replacement and Immediately Before Housing Liner Replacement |
| Present Invention | 0.12 | 0.14 | 0.14 |
| Conventional Method | 0.20 | 0.55 | 0.87 |

As described above, according to the method of the present invention, rolling direction forces of the work rolls are measured before rolling, and the chock positions of the respective rolls are controlled with respect to a reference roll so that the rolling direction forces enter an allowable range based on appropriate logic, and by this means an inter-roll cross itself is eliminated, and left-right asymmetric deformation of a workpiece that occurs due to thrust forces caused by an inter-roll cross can be eliminated. Therefore, a metal plate material can be stably produced without zigzagging and camber or with extremely little zigzagging and camber.

Whilst preferred embodiments of the present invention have been described in detail above with reference to the accompanying drawings, the present invention is not limited to the above examples. It is clear that a person having common knowledge in the field of the art to which the present invention pertains will be able to contrive various examples of changes and modifications within the category of the technical idea described in the appended claims, and it should be understood that they also naturally belong to the technical scope of the present invention.

For example, whilst a four-high rolling mill having a pair of work rolls and a pair of backup rolls has been described in the above embodiments, the present invention is also applicable to a rolling mill of four-high or more. For example, in the case of a six-high rolling mill, a reference roll to serve as the reference for adjustment of the positions of roll chocks is set, and in such case, it suffices to set a roll located at the lowermost part or the uppermost part among the respective rolls arranged in the vertical direction, as the reference roll.

Figure 15:
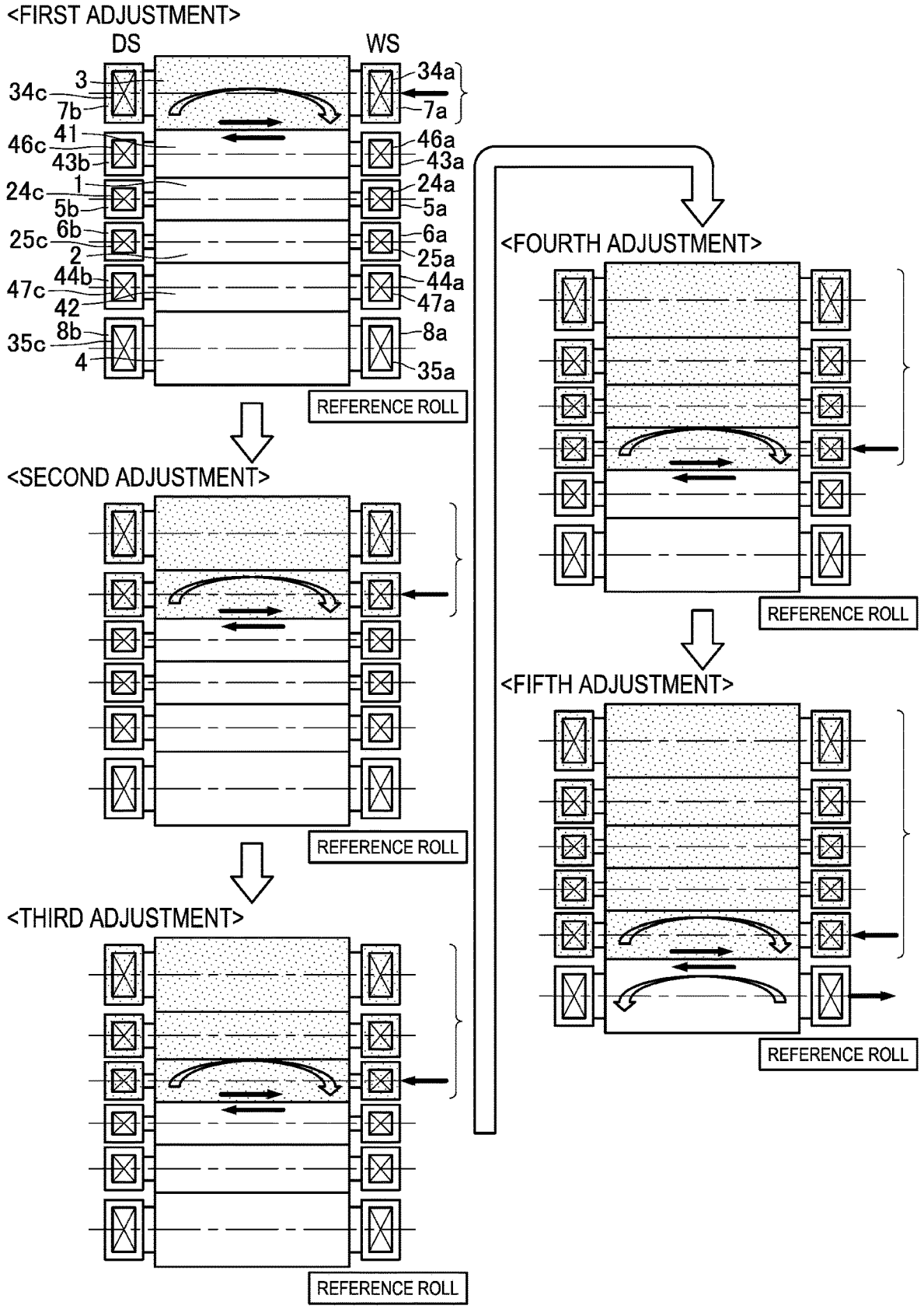
FIG. 15 is an explanatory drawing illustrating procedures for roll position adjustment in a case where the method for setting a rolling mill illustrated in FIG. 4 is applied to a six-high rolling mill.

For example, as illustrated in FIG. 15, in a six-high rolling mill, as the plurality of rolls, intermediate rolls 41 and 42 are provided between the work roll 1 and the backup roll 3, and the work roll 2 and the backup roll 4, respectively. The upper intermediate roll 41 is supported by an upper intermediate roll chock 43*a* on the work side and an upper intermediate roll chock 43*b* on the drive side. The lower intermediate roll 42 is supported by a lower intermediate roll chock 44*a* on the work side and a lower intermediate roll chock 44*b* on the drive side. Note that, the upper intermediate roll chocks 43*a* and 43*b* and the lower intermediate roll chocks 44*a* and 44*b* are also sometimes referred to as simply "roll chocks".

In the upper work roll 1, the rolling direction force measurement apparatuses 24*a* to 24*d* that measure rolling direction forces applied to the upper work roll 1 are provided, and in the lower work roll 2, the rolling direction force measurement apparatuses 25*a* to 25*d* that measure rolling direction forces applied to the lower work roll 2 are provided. Similarly, in the upper backup roll 3, the rolling direction force measurement apparatuses 34*a* to 34*d* that measure rolling direction forces applied to the upper backup roll 3 are provided, and in the lower backup roll 4, the rolling direction force measurement apparatuses 35*a* to 35*d* that measure rolling direction forces applied to the lower backup roll 4 are provided. Further, in the upper intermediate roll 41, rolling direction force measurement apparatuses 46*a*, 46*c* that measure rolling direction forces applied to the upper intermediate roll 41 are provided, and in the lower intermediate roll 42, rolling direction force measurement apparatuses 47*a*, 47*c* that measure rolling direction forces applied to the lower intermediate roll 42 are provided.

For example, when performing adjustment of an inter-roll cross angle in a kiss roll state, as illustrated in FIG. 15, similarly to the case of the four-high rolling mill illustrated in FIG. 4, it suffices to perform adjustment of the roll chock positions in sequence from the roll chocks of the backup roll on the opposite side to the reference roll so that the rolling direction force differences fall within an allowable range.

That is, when performing adjustment of the six-high rolling mill illustrated in FIG. 15, the adjustment is performed in sequence as follows: a first adjustment is performed that performs a roll chock adjustment between the upper backup roll chocks 7*a* and 7*b* of the upper backup roll 3 and the upper intermediate roll chocks 43*a* and 43*b* of the upper intermediate roll 41; a second adjustment is performed that performs a roll chock adjustment between the upper intermediate roll chocks 43*a* and 43*b* of the upper intermediate roll 41 and the upper work roll chocks 5*a* and 5*b* of the upper work roll 1; a third adjustment is performed that performs a roll chock adjustment between the upper work roll chocks 5*a* and 5*b* of the upper work roll 1 and the lower work roll chocks 6*a* and 6*b* of the lower work roll 2; a fourth adjustment is performed that performs a roll chock adjustment between the lower work roll chocks 6*a* and 6*b* of the lower work roll 2 and the lower intermediate roll chocks 44*a* and 44*b* of the lower intermediate roll 42; and a fifth adjustment is performed that performs a roll chock adjustment between the lower intermediate roll chocks 44*a* and 44*b* of the lower intermediate roll 42 and the lower backup roll chocks 8*a* and 8*b* of the lower backup roll 4. At this time, in the second adjustment to fifth adjustment, the roll chocks that were already adjusted prior thereto are controlled simultaneously with and in the same direction as the roll chocks that are being adjusted, while maintaining the relative positions with respect to the roll chocks that are being adjusted.

Figure 16:
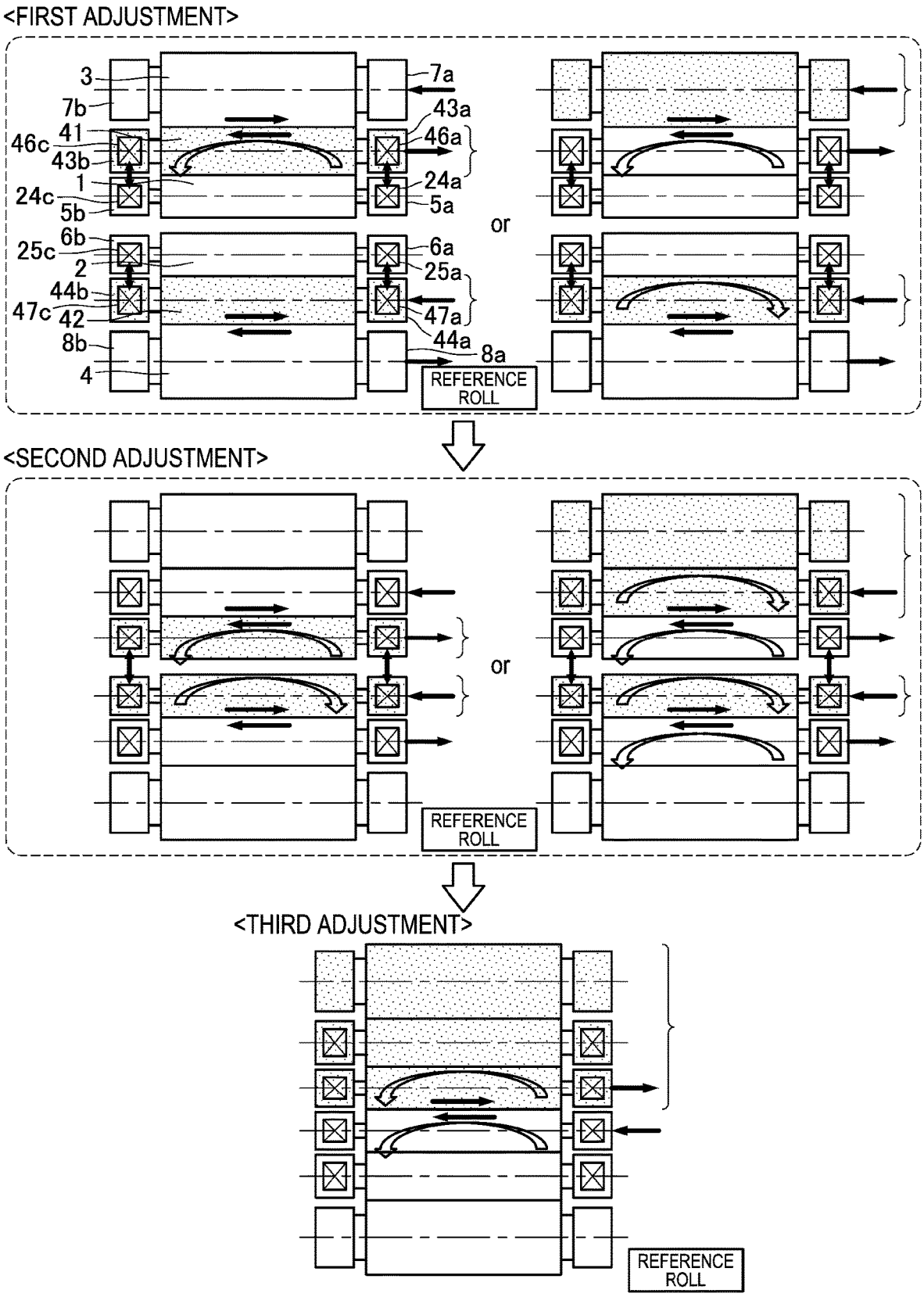
FIG. 16 is an explanatory drawing illustrating procedures for roll position adjustment in a case where the method for setting a rolling mill illustrated in FIG. 7 is applied to a six-high rolling mill.

Further, when performing adjustment of an inter-roll cross angle when the roll gap is in an open state, for example as illustrated in FIG. 16, similarly to the case of the four-high rolling mill illustrated in FIG. 7, it suffices to set the upper work roll and the lower work roll in an open state and perform adjustment of the roll chocks of the upper roll assembly and the lower roll assembly, respectively, and thereafter set the upper work roll and the lower work roll in a kiss roll state and perform adjustment between the roll chocks of the upper roll assembly and the roll chocks of the lower roll assembly. Note that, in the six-high rolling mill illustrated in FIG. 16, rolling direction force measurement apparatuses are not provided in the upper backup roll 3 and the lower backup roll 4, and similarly to FIG. 15, the rolling direction force measurement apparatuses 24*a* to 24*d*, 25*a* to 25*d*, 46*a*, 46*c* 47*a*, and 47*c* are provided only in the upper work roll 1, the lower work roll 2, the upper intermediate roll 41 and the lower intermediate roll 42, respectively.

For example, when performing adjustment of the six-high rolling mill illustrated in FIG. 16, first, the roll gap between the work rolls 1 and 2 is set in an open state, and for the upper roll assembly and the lower roll assembly, respectively, a first adjustment is performed to adjust the positions between the roll chocks 43*a*, 43*b*, 44*a* and 44*b* of the intermediate rolls 41 and 42 and the roll chocks 7*a*, 7*b*, 8*a* and 8*b* of the backup rolls 3 and 4. Subsequently, after finishing the first adjustment, the roll gap between the work rolls 1 and 2 is maintained in an open state, and for the upper roll assembly and the lower roll assembly, respectively, a second adjustment is performed to adjust the positions between the roll chocks 43*a*, 43*b*, 44*a* and 44*b* of the intermediate rolls 41 and 42 and the roll chocks 5*a*, 5*b*, 6*a* and 6*b* of the work rolls 1 and 2. After finishing the second adjustment, the work rolls 1 and 2 are set in a kiss roll state, and either one of the upper roll assembly and the lower roll assembly is decided on as the reference roll assembly. In the example in FIG. 16, the lower roll assembly is adopted as the reference roll assembly. Next, the roll chock positions of the reference roll assembly are fixed as reference positions, and a third adjustment is performed in which the positions of the roll chocks are adjusted between the upper roll assembly and the lower roll assembly by controlling the roll chocks 5*a*, 5*b*, 43*a*, 43*b*, 7*a* and 7*b* of the respective rolls 1, 41, 3 of the upper roll assembly simultaneously and in the same direction while maintaining the relative positions between the roll chocks 5*a*, 5*b*, 43*a*, 43*b*, 7*a* and 7*b*.

Note that, in the first adjustment and the second adjustment, bending apparatuses of the intermediate rolls 41 and 42 are used to apply loads between the intermediate rolls 41 and 42 and the backup rolls 3 and 4, and the bending apparatuses of the work rolls 1 and 2 are set at zero or in a balanced state.

Thus, the present invention is also applicable to a six-high rolling mill, and not just a four-high rolling mill. Furthermore, the present invention is similarly applicable to rolling mills other than a four-high rolling mill and a six-high rolling mill, and for example the present invention can also be applied to an eight-high rolling mill or a five-high rolling mill.

REFERENCE SIGNS LIST

1 Upper work roll
2 Lower work roll
3 Upper backup roll
4 Lower backup roll
5*a* Upper work roll chock (work side)
5*b* Upper work roll chock (drive side)
6*a* Lower work roll chock (work side)
6*b* Lower work roll chock (drive side)
7*a* Upper backup roll chock (work side)
7*b* Upper backup roll chock (drive side)
8*a* Lower backup roll chock (work side)
8*b* Lower backup roll chock (drive side)
9 Upper work roll chock pressing apparatus
10 Lower work roll chock pressing apparatus
11 Driving apparatus with upper work roll chock position detection function
12 Driving apparatus with lower work roll chock position detection function
13 Upper backup roll chock pressing apparatus
14 Driving apparatus with upper backup roll chock position detection function
15 Roll chock rolling direction force control unit
16 Roll chock position control unit
21 Driving electric motor
22 Driving electric motor control unit
23 Inter-roll cross control unit
24*a* Upper work roll chocks entrance-side rolling direction force measurement apparatus (work side)
24*b* Upper work roll chocks exit-side rolling direction force measurement apparatus (work side)
24*c* Upper work roll chocks entrance-side rolling direction force measurement apparatus (drive side)
24*d* Upper work roll chocks exit-side rolling direction force measurement apparatus (drive side)
25*a* Lower work roll chocks entrance-side rolling direction force measurement apparatus (work side)
25*b* Lower work roll chocks exit-side rolling direction force measurement apparatus (work side)
25*c* Lower work roll chocks entrance-side rolling direction force measurement apparatus (drive side)
25*d* Lower work roll chocks exit-side rolling direction force measurement apparatus (drive side)
26 Upper work-roll rolling direction force calculation apparatus (work side)
27 Lower work-roll rolling direction force calculation apparatus (work side)
28 Upper work roll work side-drive side difference calculation apparatus (work side)
29 Lower work roll work side-drive side difference calculation apparatus (work side)
30 Housing
34*a* Upper backup roll chocks entrance-side rolling direction force measurement apparatus (work side)
34*b* Upper backup roll chocks exit-side rolling direction force measurement apparatus (work side)
34*c* Upper backup roll chocks entrance-side rolling direction force measurement apparatus (drive side)
34*d* Upper backup roll chocks exit-side rolling direction force measurement apparatus (drive side)
35*a* Lower backup roll chocks entrance-side rolling direction force measurement apparatus (work side)
35*b* Lower backup roll chocks exit-side rolling direction force measurement apparatus (work side)
35*c* Lower backup roll chocks entrance-side rolling direction force measurement apparatus (drive side)
35*d* Lower backup roll chocks exit-side rolling direction force measurement apparatus (drive side)
36 Upper backup roll rolling direction force calculation apparatus (work side)
37 Lower backup roll rolling direction force calculation apparatus (work side)
38 Upper backup roll work side-drive side difference calculation apparatus (work side)
39 Lower backup roll work side-drive side difference calculation apparatus (work side)
40 Lower backup roll chock pressing apparatus

41 Upper intermediate roll
42 Lower intermediate roll
43*a* Upper intermediate roll chock (work side)
43*b* Upper intermediate roll chock (drive side)
44*a* Lower intermediate roll chock (work side)
44*b* Lower intermediate roll chock (drive side)
46*a* Upper intermediate roll chocks entrance-side rolling direction force measurement apparatus (work side)
46*c* Upper intermediate roll chocks entrance-side rolling direction force measurement apparatus (drive side)
47*a* Lower intermediate roll chocks entrance-side rolling direction force measurement apparatus (work side)
47*c* Lower intermediate roll chocks entrance-side rolling direction force measurement apparatus (drive side)
50 Pressing-down device
61*a* Entrance-side upper increase bending apparatus (work side)
61*b* Exit-side upper increase bending apparatus (work side)
62*a* Entrance-side lower increase bending apparatus (work side)
62*b* Exit-side lower increase bending apparatus (work side)
63 Increase bending control unit

The invention claimed is:

1. A rolling mill of four-high or more that includes a plurality of rolls including at least a pair of work rolls and a pair of backup rolls supporting the work rolls, wherein any one roll among respective rolls arranged in a vertical direction is adopted as a reference roll, the rolling mill comprising: two hydraulic cylinders, which face each other in a rolling direction on either side of roll chocks of the rolls other than the reference roll, is provided on either one of an entrance side and an exit side in the rolling direction, the hydraulic cylinders pressing at least the roll chocks of the rolls other than the reference roll in the rolling direction, the hydraulic cylinders moving at least the roll chocks of the rolls other than the reference roll in the rolling direction; and a position controller configured to fix a rolling direction position of roll chocks of the reference roll as a reference position, and based on a rolling direction force difference, which is the difference between rolling direction forces in a rolling direction which act on roll chocks on a work side and roll chocks on a drive side of each of at least the rolls other than the backup rolls, drive the hydraulic cylinders to control positions in the rolling direction of the roll chocks of the rolls other than the reference roll so that the rolling direction force difference of each of the rolls becomes a value within an allowable range.

2. The rolling mill according to claim 1, wherein a roll located at a lowermost part or an uppermost part in the vertical direction among the plurality of rolls is adopted as the reference roll.

3. The rolling mill according to claim 1, wherein the position controller is further configured to set a roll gap between the work rolls in an open state, and impart a bending force by means of a bending controller to the roll chocks of the work rolls.

4. The rolling mill according to claim 1, wherein the hydraulic cylinders comprise a roll chock position detection apparatus.

5. The rolling mill according to claim 2, wherein the position controller is further configured to set a roll gap between the work rolls in an open state, and impart a bending force by means of a bending controller to the roll chocks of the work rolls.

6. The rolling mill according to claim 2, wherein the hydraulic cylinders comprise a roll chock position detection apparatus.

7. The rolling mill according to claim 3, wherein the hydraulic cylinders comprise a roll chock position detection apparatus.

8. The rolling mill according to claim 5 wherein the hydraulic cylinders comprise a roll chock position detection apparatus.

9. A method for setting a rolling mill, the rolling mill being a rolling mill of four-high or more that includes a plurality of rolls including at least a pair of work rolls and a pair of backup rolls supporting the work rolls, the method for setting a rolling mill being executed before reduction position zero point adjustment or before starting rolling, wherein any one roll among respective rolls arranged in a vertical direction is adopted as a reference roll, the method comprising:

measuring at least rolling direction forces in a rolling direction that act on roll chocks on a work side and roll chocks on a drive side of the rolls other than the backup rolls, and fixing a rolling direction position of roll chocks of the reference roll as a reference position, and moving roll chocks of the rolls other than the reference roll in a rolling direction of a workpiece to adjust positions of the roll chocks so that a rolling direction force difference that is a difference between a rolling direction force measured on the work side and a rolling direction force measured on the drive side falls within an allowable range.

10. The method for setting a rolling mill according to claim 9, wherein a roll located at a lowermost part or an uppermost part in the vertical direction among the plurality of rolls is adopted as the reference roll.

11. The method for setting a rolling mill according to claim 10, wherein:

the rolling mill includes a plurality of rolls, including one roll of the pair of work rolls as an upper work roll and one roll of the pair of backup rolls as an upper backup roll, provided on an upper side in the vertical direction with respect to the workpiece, and a plurality of rolls, including another roll of the pair of work rolls as a lower work roll and another roll of the pair of backup rolls as a lower backup roll, provided on a lower side in the vertical direction with respect to the workpiece, from a roll assembly having an order of the lower backup roll, the lower work roll, the upper work roll, and the upper backup roll, starting on an opposite side to the reference roll, the roll chocks of the rolls are moved in the rolling direction of the workpiece to adjust the positions of the roll chocks so that the rolling direction force differences arising at each of the rolls that are adjacent fall within an allowable range, and at such time, the roll chocks of the rolls for which the position of the roll chocks is already adjusted are controlled simultaneously and in a same direction while maintaining relative positions with respect to the roll chocks of the roll that is being adjusted.

12. The method for setting a rolling mill according to claim 10, wherein:

the rolling mill is a four-high rolling mill, a plurality of rolls, including one roll of the pair of work rolls and one roll of the pair of backup rolls, provided on an upper side in the vertical direction with respect to the workpiece are adopted as an upper roll assembly, and a plurality of rolls, including an other roll of the pair of work rolls and an other roll of the pair of backup rolls, provided on a lower side in the vertical direction with respect to the workpiece are adopted as a lower roll assembly;

the method including performing:

a first adjustment in which a roll gap between the work rolls is set in an open state, and with respect to each of the upper roll assembly and the lower roll assembly, positions of the roll chocks of the work roll and the roll chocks of the backup roll are adjusted, and after the first adjustment ends, a second adjustment in which the work rolls are set in a kiss roll state, and either one of the upper roll assembly and the lower roll assembly is adopted as a reference roll assembly including the reference roll, and adjust the roll assembly opposite to the reference roll is adjusted by controlling the roll chocks simultaneously and in a same direction while maintaining relative positions between the roll chocks; and in the first adjustment, with respect to each of the upper roll assembly and the lower roll assembly, in a state in which a bending force is applied to the roll chocks of the work rolls, the roll chocks of the work roll on the reference roll side and either one of the roll chocks of the work roll and the roll chocks of the backup roll of the roll assembly on the opposite side to the reference roll are moved in the rolling direction of the workpiece to adjust positions of the roll chocks so that the rolling direction force difference measured falls within an allowable range.

13. The method for setting a rolling mill according to claim 10, wherein:

the rolling mill is a six-high rolling mill comprising intermediate rolls between the work rolls and the backup rolls, respectively, a plurality of rolls, including one intermediate roll of the intermediate rolls, one roll of the pair of work rolls and one roll of the pair of backup rolls, provided on an upper side in the vertical direction with respect to the workpiece are adopted as an upper roll assembly, and a plurality of rolls, including an other intermediate roll of the intermediate rolls, an other roll of the pair of work rolls and an other roll of the pair of backup rolls, provided on a lower side in the vertical direction with respect to the workpiece are adopted as a lower roll assembly;

the method including performing:

a first adjustment in which a roll gap between the work rolls is set in an open state, and with respect to each of the upper roll assembly and the lower roll assembly, positions of the roll chocks of the intermediate roll and the roll chocks of the backup roll are adjusted, after the first adjustment ends, a second adjustment in which the roll gap between the work rolls is maintained in an open state, and with respect to each of the upper roll assembly and the lower roll assembly, positions of the roll chocks of the intermediate roll and the roll chocks of the work roll are adjusted, and after the second adjustment ends, a third adjustment in which the work rolls are set in a kiss roll state, either one of the upper roll assembly and the lower roll assembly is adopted as a reference roll assembly including the reference roll, and adjust the roll assembly opposite to the reference roll is adjusted by controlling the roll chocks simultaneously and in a same direction while maintaining relative positions between the roll chocks;

wherein:

the first adjustment and the second adjustment are performed in a state in which a bending force is applied to the roll chocks of the intermediate rolls and the roll chocks of the work rolls;

in the first adjustment, with respect to each of the upper roll assembly and the lower roll assembly, the roll chocks of the intermediate roll on the reference roll assembly and either one of the roll chocks of the intermediate roll and the roll chocks of the backup roll of a roll assembly is one of the upper roll assembly and the lower roll assembly, differ from the reference roll assembly, are moved in the rolling direction of the workpiece to adjust positions of the roll chocks so that the rolling direction force differences measured fall within an allowable range; and in the second adjustment, with respect to each of the upper roll assembly and the lower roll assembly:

the roll chocks of the work roll on the reference roll assembly and either one of the roll chocks of the work roll and the roll chocks of the intermediate roll of the roll assembly on the opposite side to the reference roll are moved in the rolling direction of the workpiece to adjust positions of the roll chocks so that the rolling direction force differences measured fall within an allowable range, and in a case of moving the roll chocks of the intermediate roll of the roll assembly on the opposite side to the reference roll, the roll chocks of the intermediate roll and the roll chocks of the backup roll that is adjacent to the intermediate roll are controlled simultaneously and in a same direction while maintaining relative positions between the roll chocks of the intermediate roll and the roll chocks of the backup roll.

* * * * *